US006151939A

United States Patent [19]

Hanna et al.

[11] Patent Number: 6,151,939

[45] Date of Patent: Nov. 28, 2000

[54] CAN SHAPING APPARATUS

[75] Inventors: Joseph C. Hanna, Lynchburg, Va.; Otis Willoughby, Boulder; Greg Robinson, Louisville, both of Colo.

[73] Assignee: Delaware Capital Formation, Inc., Wilmington, Del.

[21] Appl. No.: 08/917,330

[22] Filed: Aug. 25, 1997

Related U.S. Application Data

[63] Continuation-in-part of application No. 08/582,866, Jan. 4, 1996, Pat. No. 5,916,317.

[51] Int. Cl.[7] ..... B21D 26/02

[52] U.S. Cl. ..... 72/61; 72/62; 29/421.1

[58] Field of Search ..... 72/54, 56, 61, 72/62, 63; 29/421.1

[56] References Cited

U.S. PATENT DOCUMENTS

| | | |
|---|---|---|
| 701,550 | 6/1902 | Deering . |
| 1,448,457 | 3/1923 | Liddell . |
| 1,951,381 | 3/1934 | Ward . |
| 2,032,020 | 2/1936 | Koether . |
| 2,041,355 | 5/1936 | Koether . |
| 2,050,227 | 8/1936 | Mantle . |
| 2,787,973 | 4/1957 | Heidmann . |
| 3,252,312 | 5/1966 | Maier . |
| 3,320,784 | 5/1967 | Heeren et al. . |
| 3,376,723 | 4/1968 | Chelminski . |
| 3,420,079 | 1/1969 | Erlandson . |
| 3,485,073 | 12/1969 | Burney . |
| 3,526,020 | 9/1970 | Lemelson . |
| 3,559,434 | 2/1971 | Keinanen . |
| 3,566,647 | 3/1971 | Inoue . |
| 3,593,551 | 7/1971 | Roth et al. . |
| 3,613,423 | 10/1971 | Nakamura . |
| 3,688,535 | 9/1972 | Keinanen et al. . |
| 3,698,221 | 10/1972 | Couland . |
| 3,698,337 | 10/1972 | Brawner et al. . |
| 3,742,746 | 7/1973 | Erlandson . |
| 3,797,294 | 3/1974 | Roth . |
| 3,800,578 | 4/1974 | Brennan et al. . |
| 3,810,372 | 5/1974 | Queyroix . |
| 3,857,265 | 12/1974 | Howeler et al. . |
| 3,858,422 | 1/1975 | Tominaga et al. . |
| 3,953,994 | 5/1976 | Brawner et al. . |
| 3,974,675 | 8/1976 | Tominaga . |
| 4,265,102 | 5/1981 | Shimakata et al. . |
| 4,282,734 | 8/1981 | Eddy . |
| 4,353,371 | 10/1982 | Cosman . |

(List continued on next page.)

FOREIGN PATENT DOCUMENTS

| | | |
|---|---|---|
| 2047455 | 3/1972 | Germany . |
| 57-88919 | 6/1982 | Japan . |
| 537735 | 3/1977 | Russian Federation . |
| 1332461 | 10/1973 | United Kingdom . |
| 2224965 | 5/1990 | United Kingdom . |

*Primary Examiner*—David Jones
*Attorney, Agent, or Firm*—Foley & Lardner

[57] ABSTRACT

A method and apparatus for providing a contoured design confirguration in the wall of an open ended container workpiece employs plural molds on a rotating turret an which a plurality of molds are provided with each mold having an inwardly facing wall having the desired configuration. The workpiece is delivered from a pneumatic conveyor and vacuum star wheel into an open mold which then closes and the interior of the workpiece is pressurized with air. A rotary wand moves into the workpiece and discharges high velocity rotating liquid jets against the inner wall surface of the workpiece to forcefully move the wall outwardly into conforming contact with the inner wall surface of the mold to effect permanent reshaping of the workpiece into the desired configuration. Spent workfluid is continuously removed from the workpiece while the high velocity liquid jets are impinging on the inner surface of the workpiece so that static pressure does not build up in the workpiece nor play any substantial part in the reshaping operation which is effected solely by the impact force of the high velocity jets. Upon completion of the shaping of the wall, the finished container is removed from the mold and conveyed by a vacuum starwheel to a pneumatic removal corner.

17 Claims, 38 Drawing Sheets

U.S. PATENT DOCUMENTS 4,354,371 10/1982 Johnson .
4,392,292 7/1983 Irons .
4,513,497 4/1985 Finch .
4,557,128 12/1985 Costabile .
4,788,843 12/1988 Seaman et al. .
4,827,605 5/1989 Krips et al. .
4,928,509 5/1990 Nakamura .
4,947,667 8/1990 Gunkel et al. .
5,022,135 6/1991 Miller et al. .
5,115,654 5/1992 Swars et al. .
5,275,033 1/1994 Riviere .
5,339,666 8/1994 Suzuki et al. .
5,524,466 6/1996 Coe .
5,794,474 8/1998 Willoughby et al. .
5,916,317 6/1999 Willoughby et al. ..... 72/61

To Fig. 1A
To Fig. 1A
358
358
344
9
266
268
256
274
275
280
338
278
272
290
276
270
282
286
29
8
306
27
257
V
253
HP
LP
254
316
113
118
120
106
108
247
246
124
7

Fig. 23B
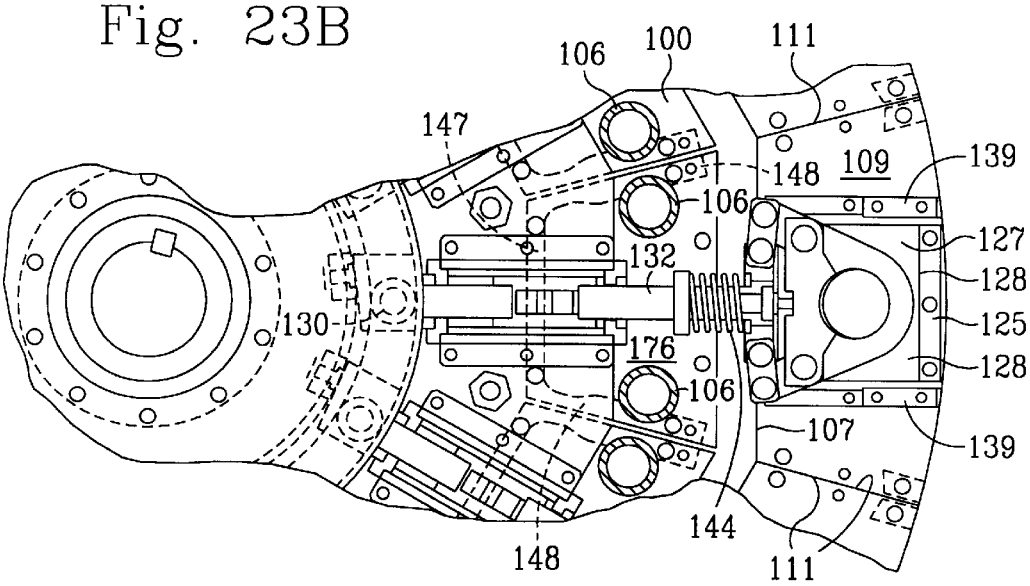
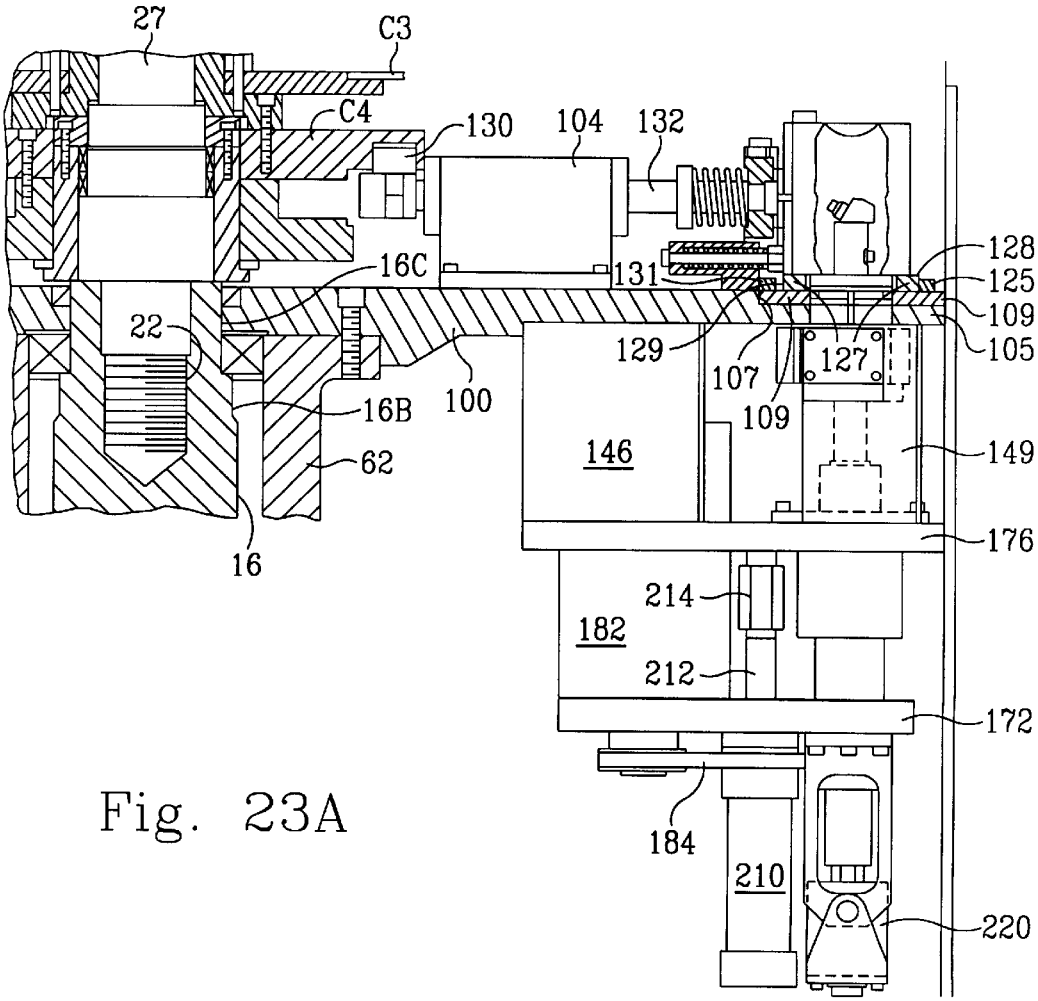
Fig. 23A

Fig. 39
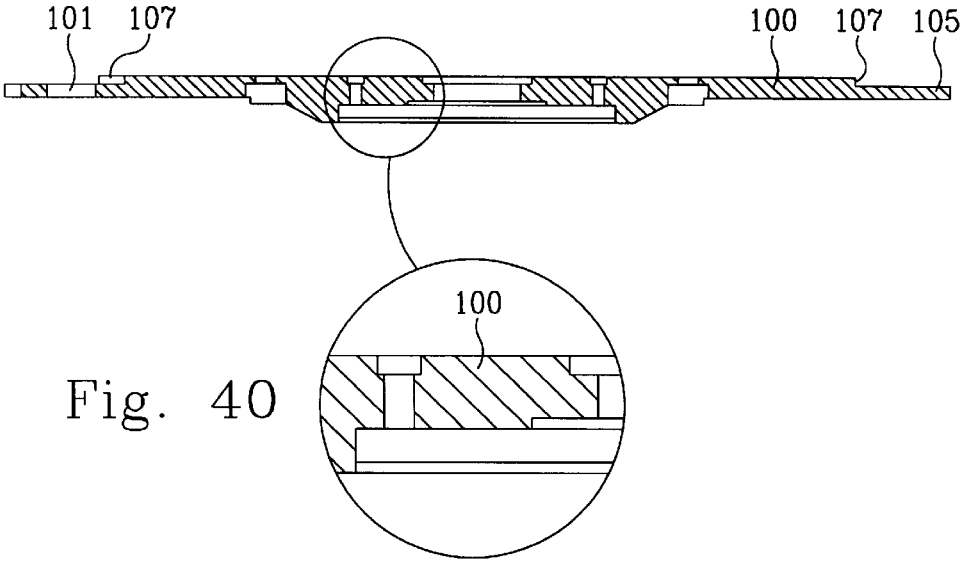
Fig. 40
Fig. 38
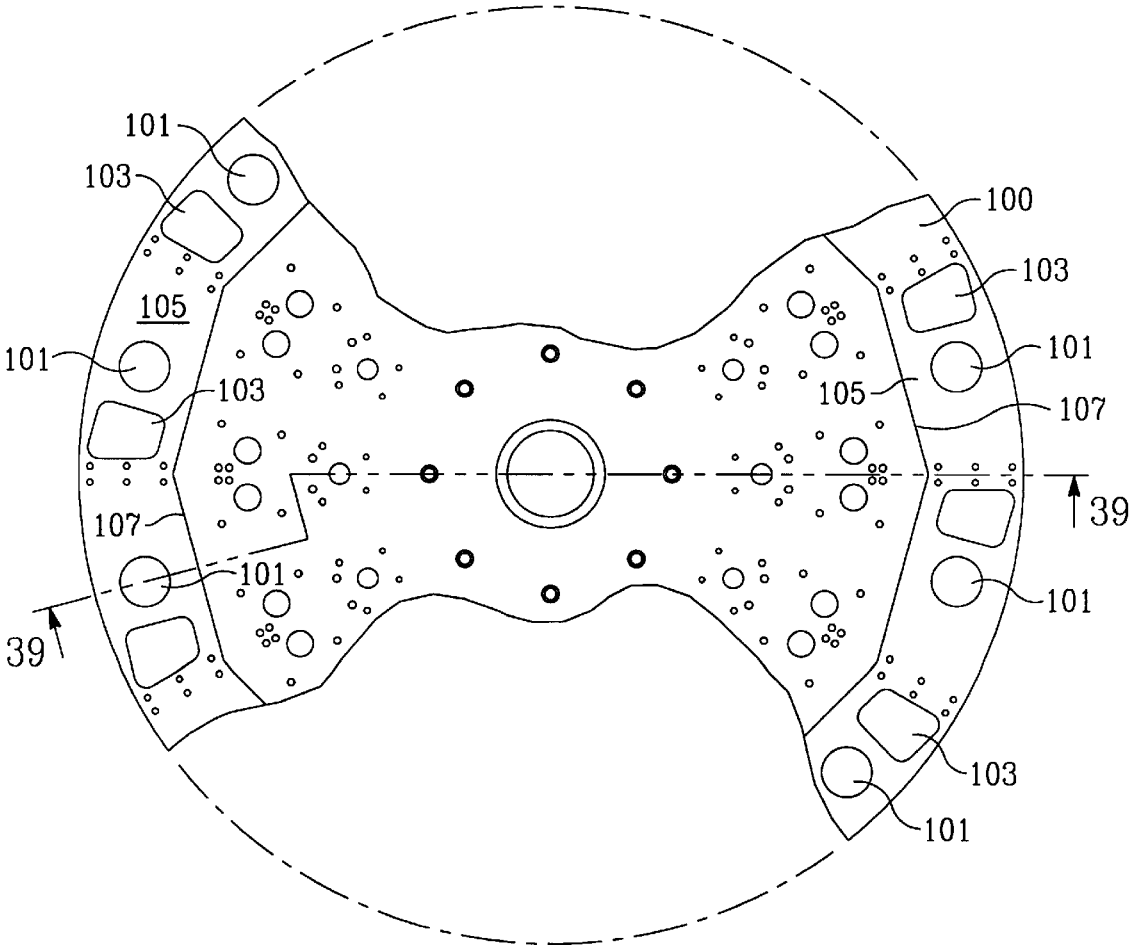

CAN SHAPING APPARATUS

CROSS REFERENCE TO RELATED APPLICATION

This application is a continuation-in-part of earlier U.S. Ser. No. 08/582,866 filed on Jan. 4, 1996, now U.S. Pat. No. 5,916,317.

BACKGROUND OF THE INVENTION

A variety of devices and methods for forming metal containers of aluminum and other metals have evolved over the years due to the continuous need for higher speed, metal use reduction and improved product appearance needs. In recent years there has been an increased emphasis on the provision of aluminum beverage containers having contoured "shaped" non-cylindrical sidewalls employing flutes, ribs, diamond, waffle or other patterns heretofore not obtainable with then known procedures. A substantial variety of approaches to the forming and shaping of metal containers and the like have evolved; however such prior art has not resulted in any high speed commercially satisfactory or acceptable devices capable of making metal beverage or the like containers with contoured sidewalls of the foregoing type.

Tominaga et al. U.S. Pat. No. 3,858,422 discloses a jet molding device using the impinging impact force of a water jet deflected by a member 21 against the workpiece 9 to configure the workpiece to the contour of the cavity 11 of mold 12 in which the workpiece is positioned.

Inoue U.S. Pat. No. 3,566,647 discloses a system for deforming a workpiece 10 by the action of a high pressure jet projected from an amiable barrel 11A. A Pump 15B creates kinetic energy which is increased by an electrode 12 from which a spark discharge flows to the wall of tube 11 to provide a shock wave. The action of the shock wave and pressure jet supposedly provide a synergistic effect giving more energy than one would anticipate from the sum of the two items.

Burney U.S. Pat. No. 3,485,073 discloses an internal peening apparatus having a lance element 11 moved up and down and rotated while ejecting shot against the internal surface of a workpiece to harden the surface.

Koether U.S. Pat Nos. 2,041,355 and 2,032,020 disclose outwardly expanding a piston wall by bombarding solid peening material forcibly thrown against the interior surface of the piston wall. The peening material is withdrawn through the conduits 31 and 32 and the pipe 25 may be moved longitudinally and rotated about its axis.

Johnson U.S. Pat. No. 4,353,371 discloses a method of pre-stressing the working surfaces of cylinders by shot peening followed by autofrettaging. The shot peening is effected by a rotating and reciprocating wand.

Faulkener et al. U.K. Patent Application Publication G.B. 2,224,965 a can reshaping apparatus employing compressed air fed through openings 56 in a mandrel 52 so that air pressure causes the can to expand to conform to the interior surface of a mold which can be opened and closed as shown.

Shimakata et al. (U.S. Pat. No. 4,265,102) discloses a method and apparatus for molding a container-like workpiece by the use of water pressure in a workpiece positioned internally of a separable upper mold half 30 and a lower mold half 19.

Coe (U.S. Pat. No. 5,524,466) discloses the use of hydraulic water jets provided through openings 8*a* in a hollow non-rotating "needle" 5 for deforming a workpiece outwardly for shaping by die means 10,11 which can be opened and closed.

FIELD OF THE INVENTION

The present invention is in the field of apparatus and methods for forming aluminum or other metal beverage containers having contoured side walls and is specifically directed to the field of apparatus and methods employing high velocity liquid jets providing impact force, with minimal reliance on static pressure, for forcing the container wall into conformity with the inner wall of a mold to permanently deform and shape the container wall.

SUMMARY OF THE INVENTION

The invention uses the impact of high velocity fluid jets impacting the interior wall of a workpiece to force the wall outwardly into conformity with the contour of a surrounding mold in which the workpiece is positioned. More specifically, nozzles providing fluid jets are axially spaced on a rotary wand positioned internally of a can positioned upside-down in a surrounding mold. The mold is formed of two hinged components which are opened to initially received the workpiece and for removal of the finished can. The wand and jets are concurrently axially moved up and down and the wand rotated about its axis inside the workpiece so that the impact of the workfluid from the jets distorts the workpiece wall outwardly to conform with the internal surface of the closed mold. The workpiece is first prestressed with air pressure on its interior and the forced outwardly by the fluid jets to conform in the interior surface of the mold. A significant aspect of the invention is the fact that the spent working fluid is continually purged from the container by the air pressure in the workpiece by a drain line while the jets are simultaneously operating; thus, static pressure does not build up in the can. Multiple identical workstations each employing the foregoing structures are mounted for rotation on radial tables supported for rotation on a vertical support column to provide a continuous process in which workpieces are fed into the apparatus and finished containers are removed from the apparatus by infeed and outfeed vacuum starwheels to effect a high speed continuous operation.

BRIEF DESCRIPTION OF THE DRAWINGS

FIG. 23A is a sectional view similar to FIG. 23 but additionally including mold details and wand control means support details;

FIG. 23B is a top plan view of FIG. 23A;

FIG. 38 is a top plan view of the rotary mold support table;

FIG. 39 is a section view taken along line 39—39 of FIG. 38;

FIG. 40 is an enlarged detailed view of a portion of FIG. 39;

DESCRIPTION OF THE PREFERRED EMBODIMENT

Figure 1A:
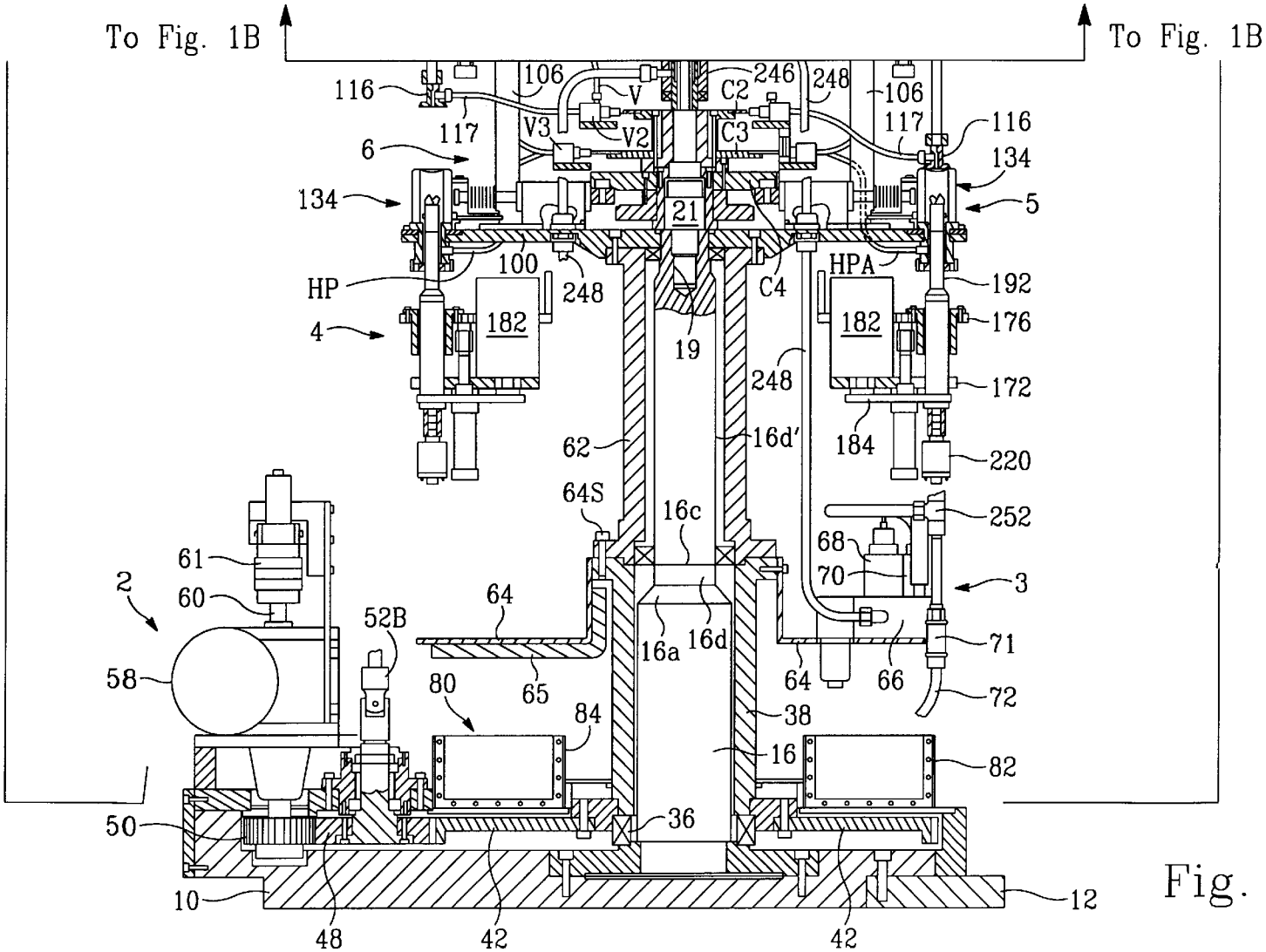
FIGS. 1A and 1B are respectively vertical elevations, partially in section, of the lowermost and uppermost components of the preferred embodiments for practice of the subject invention.
Figure 1B:
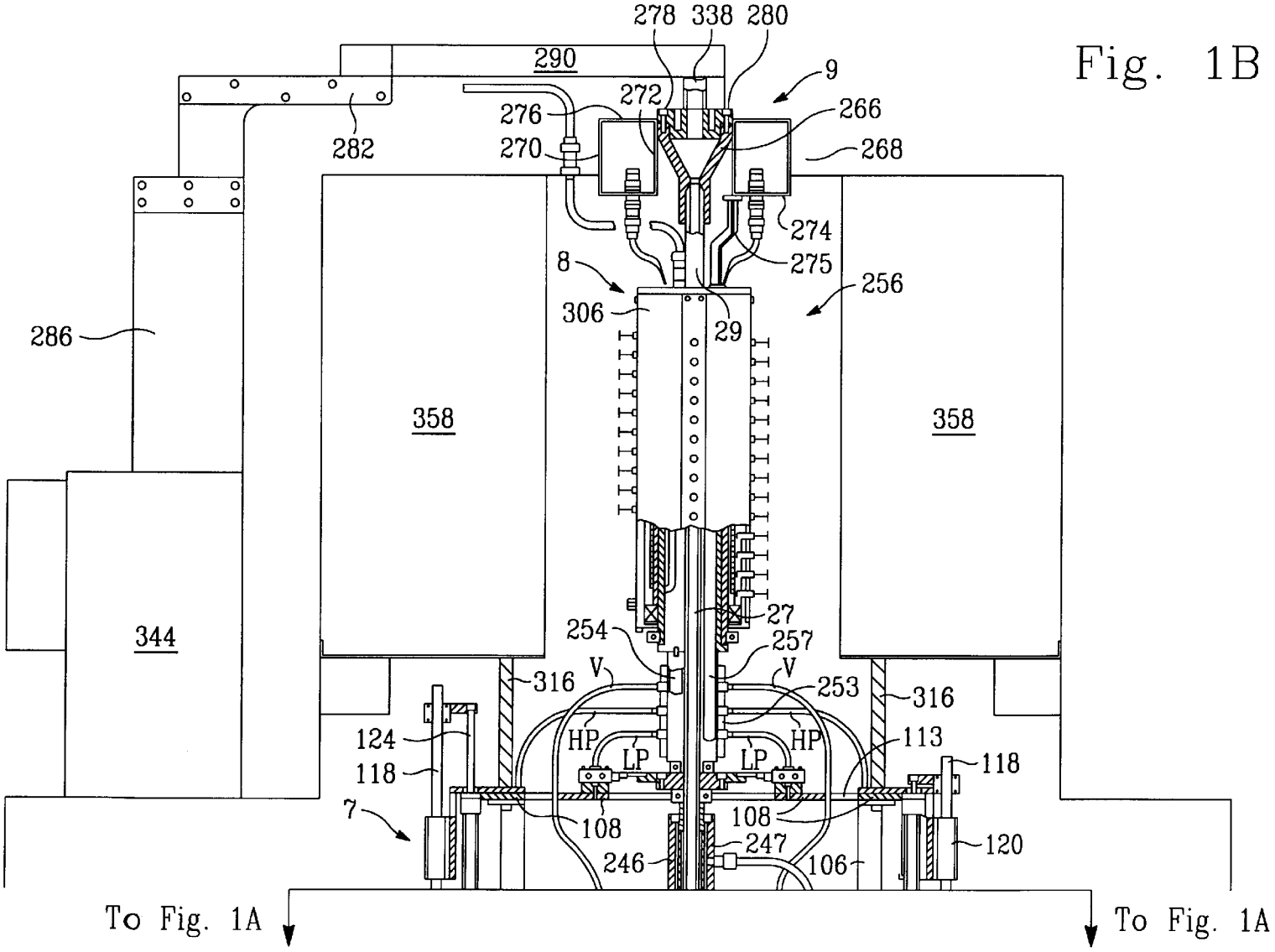
Figure 2:
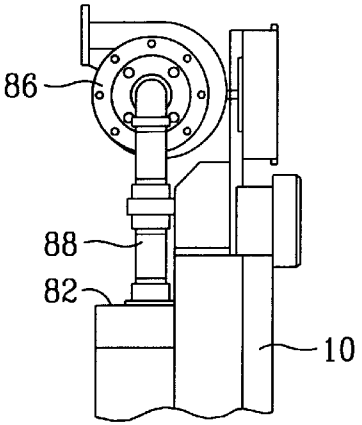
FIG. 2 is a section view taken along lines 2—2 of FIG. 1.

The primary components of the preferred embodiment of the invention are best illustrated from top to bottom in FIGS. 1A and 1B and include generally designated support and power components 2, high pressure water control valve components 3, workfluid jet wand support and control means 4, work station mold and control means 5, vacuum and air control valving 6, workpiece handling means 7, electrical control means 8 and water, air and vacuum input components 9.

Figure 3:
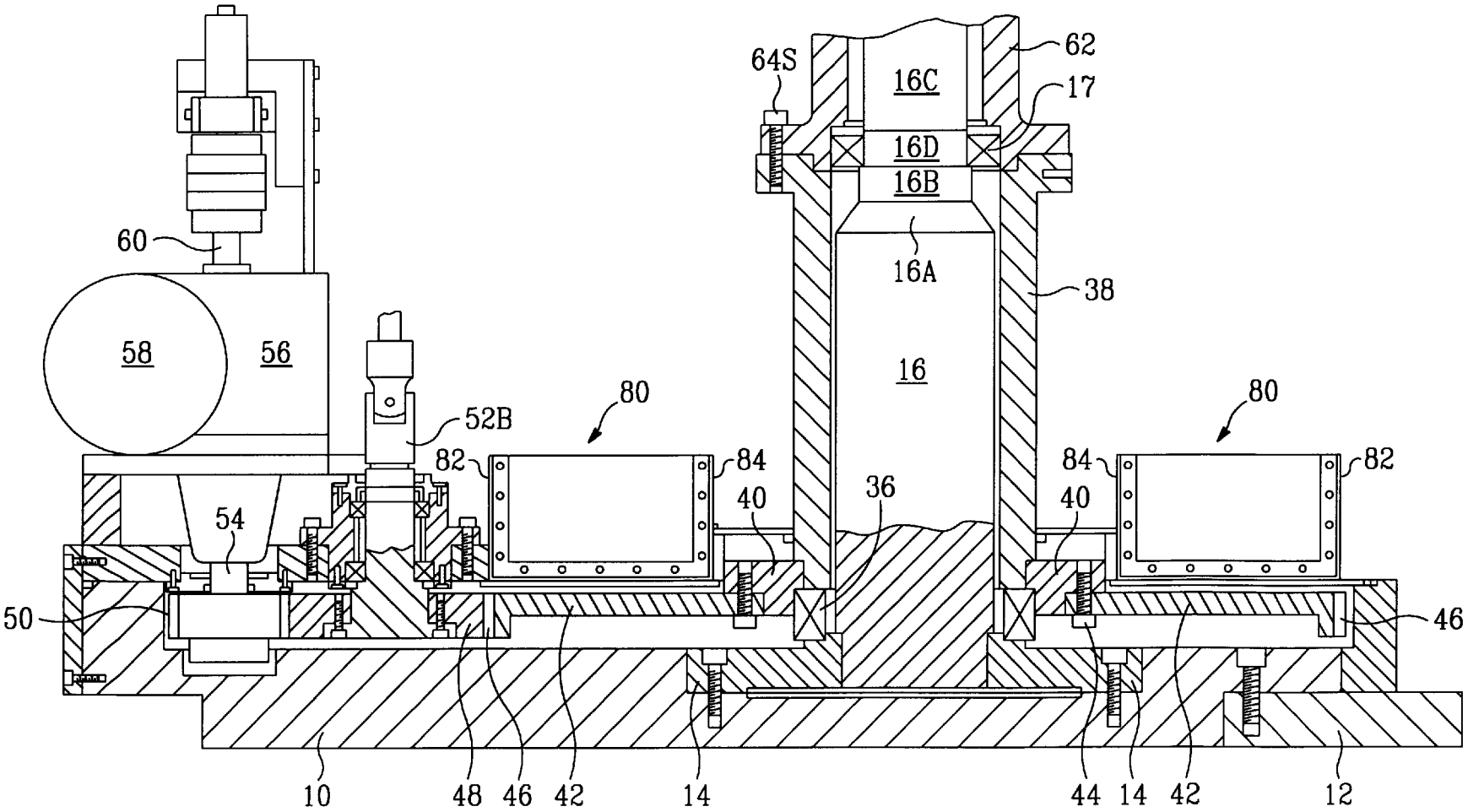
FIG. 3 is a section taken along line 3—3 of FIG. 1.
Figure 4:
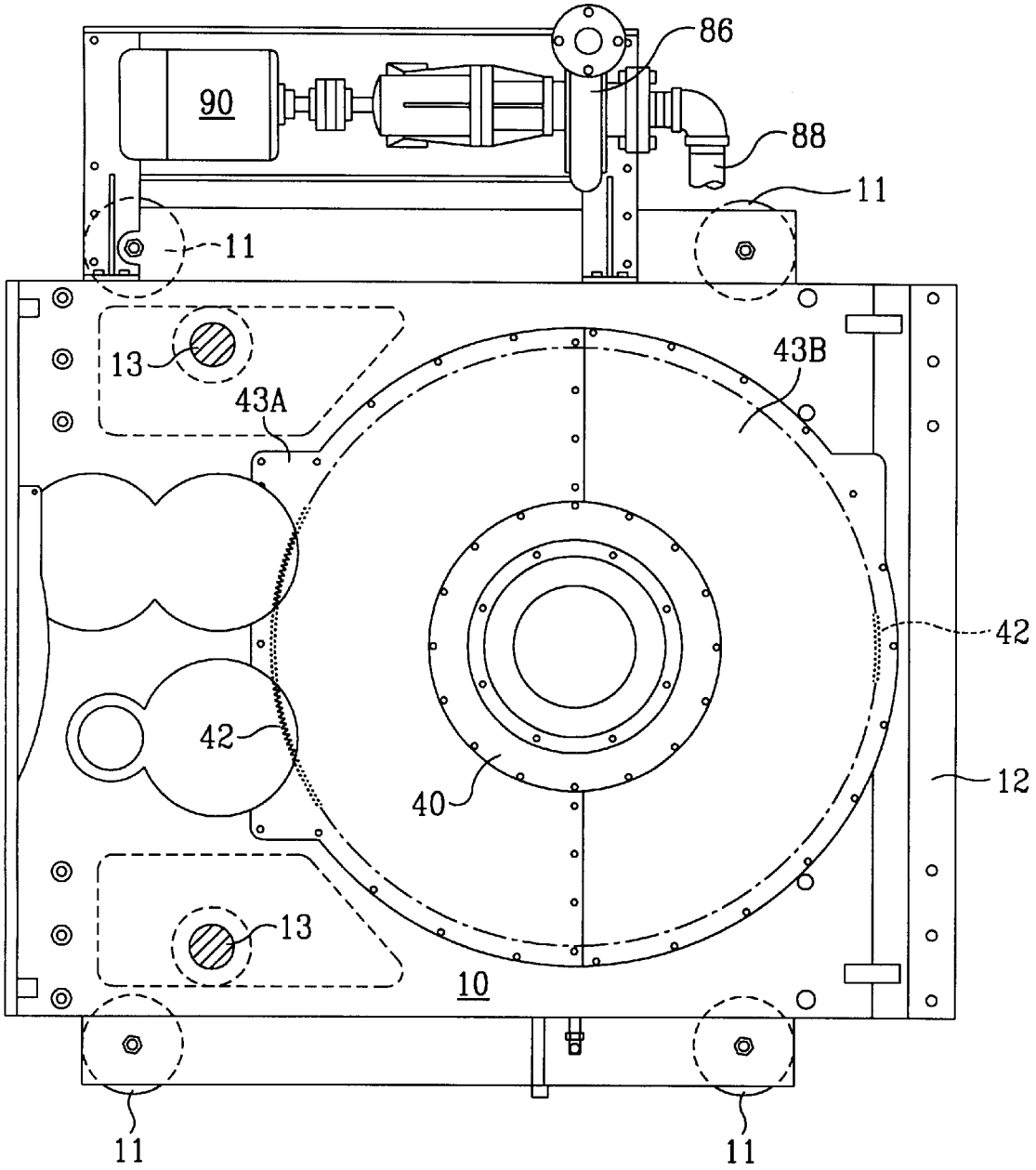
FIG. 4 is a plan view of the base assembly looking downwardly from above the main drive gear cover.
Figure 4C:
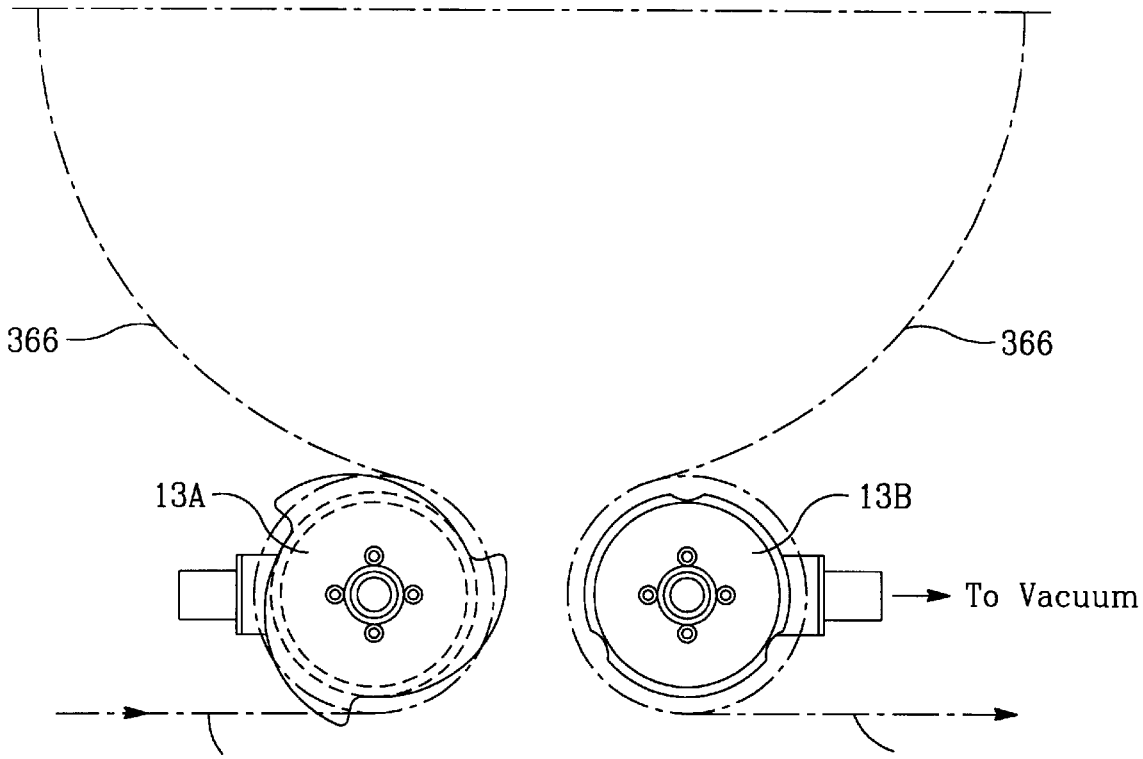
FIG. 4C is a plan view of the infeed and outfeed starwheels.
Figure 4A:
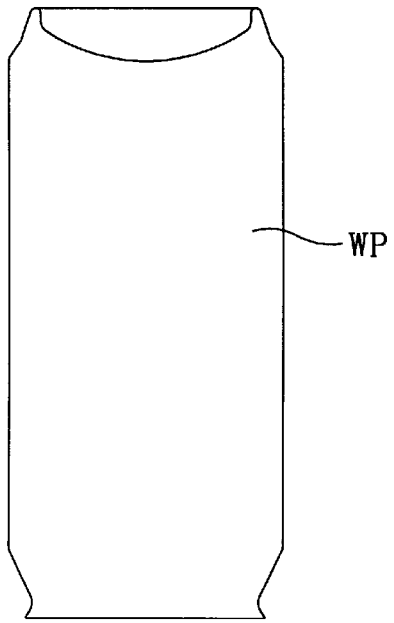
FIG. 4A is an elevation of an elevation of an inverted workpiece.
Figure 4B:
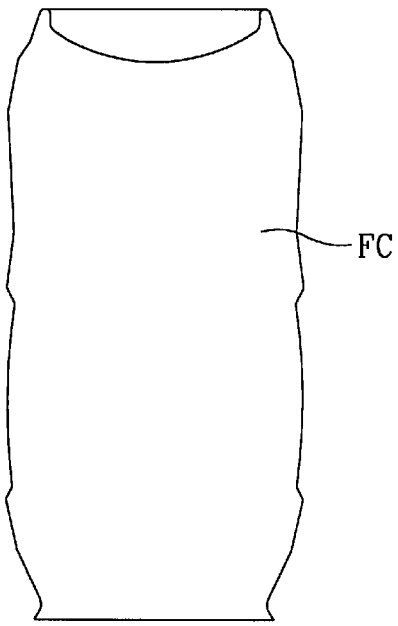
FIG. 4B is an elevation of an typical inverted container produced by the invention from use of the subject invention.
Figure 4D:
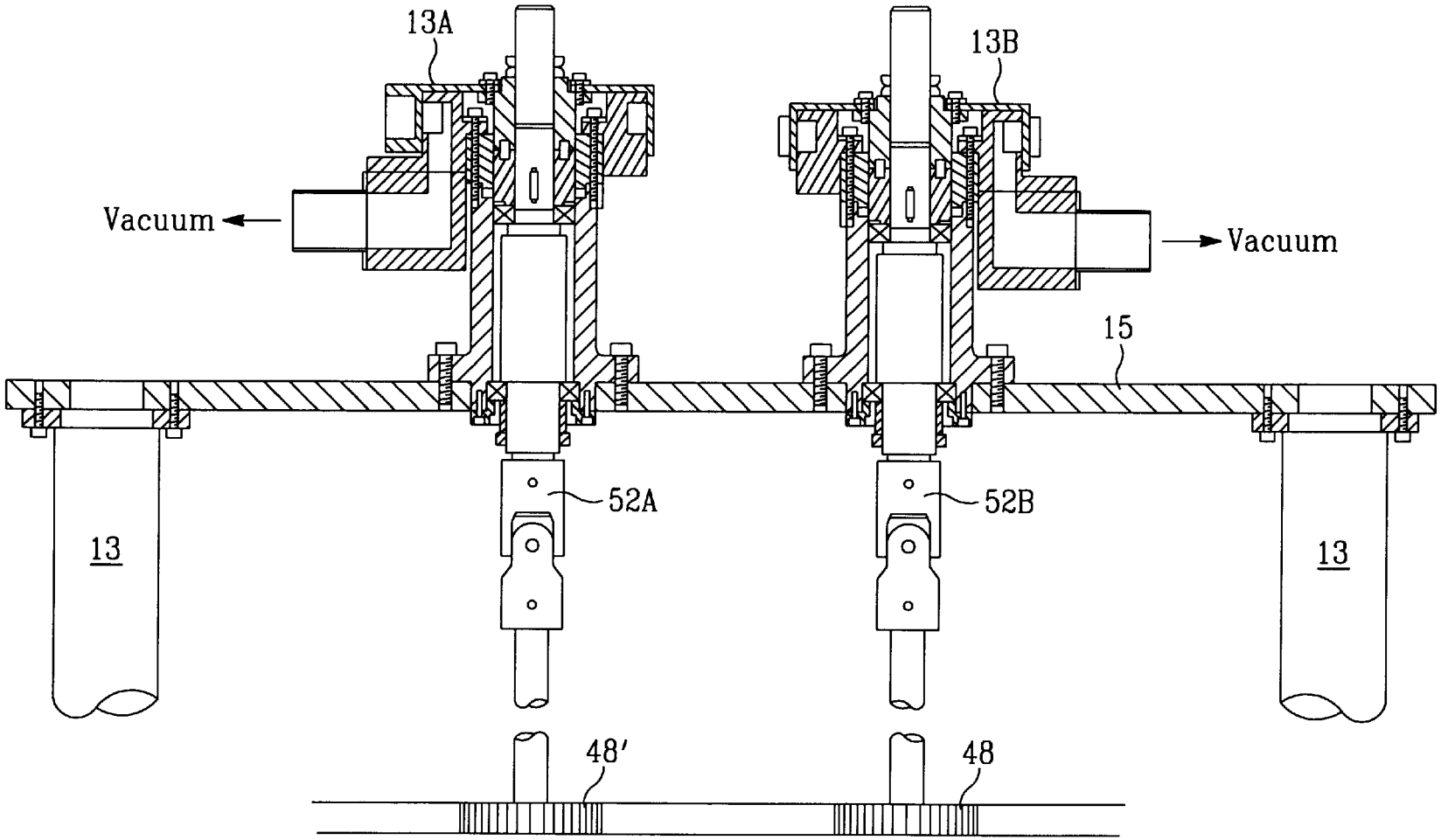
FIG. 4D is a section taken along the centers of the infeed and outfeed starwheels.
Figure 5:
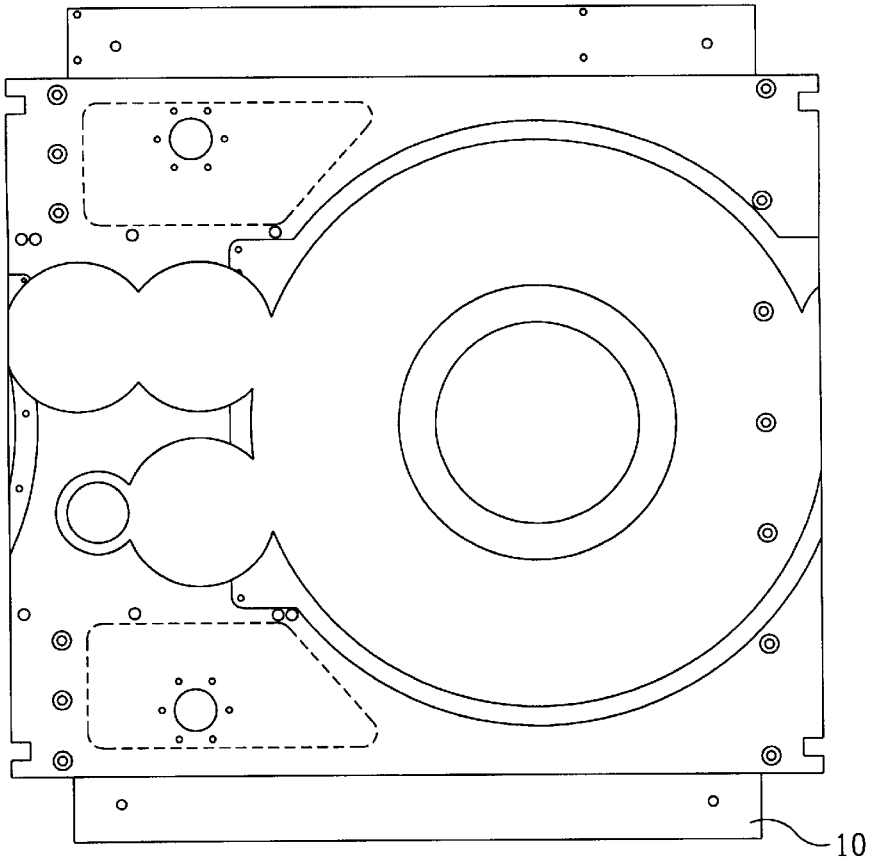
FIG. 5 is a plan view of the lower base component without any attachments.
Figure 5A:
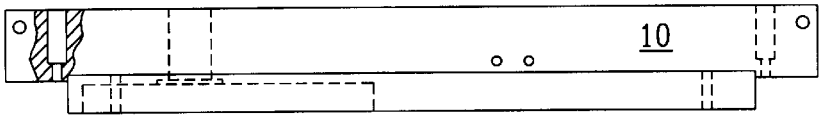
FIG. 5A is a front elevation of the lower base component of FIG. 5.
Figure 6:
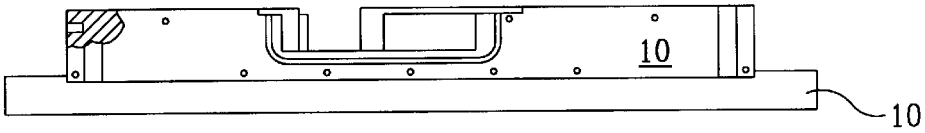
FIG. 6 is a left side elevation of the lower base component of FIG. 5.
Figure 7:
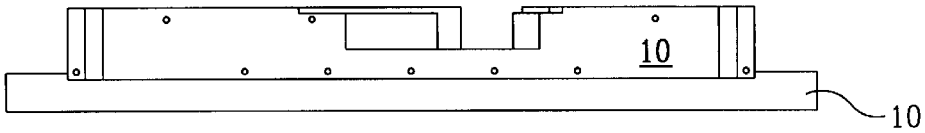
FIG. 7 is a right side elevation of the lower base component of FIG. 5.
Figure 10:
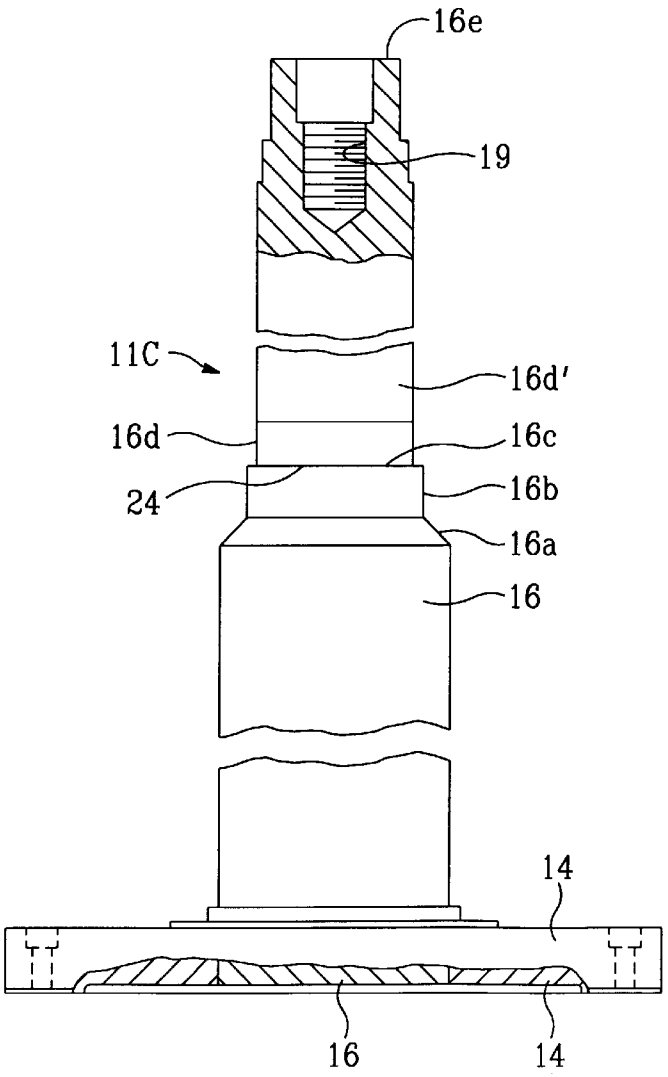
FIG. 10 is a front elevation of the lowermost component of the main support column of the preferred embodiment.

The supporting structure includes a cast iron base 10 and an associated bottom tie plate 12 rigidly connected thereto as shown in FIGS. 1A and 3. Base 10 is stabilized and leveled by a plurality of adjustable leveler devices 11 provided on its periphery. A main support column 1 IC shown standing alone in FIG. 10 has a lower column component 16 supported by an annular base plate 14 which is attached to base 10 by machine screws. Additionally, cylindrical standards 13 (FIGS. 4 and 1A) extend upwardly from base 10 and support a rigid support plate 15 on which an infeed vacuum starwheel 13A and outfeed vacuum starwheel 13B are mounted as shown in FIGS. 4C and 4D. Infeed vacuum starwheel 13A feed workpieces WP (FIG. 4A) into the apparatus and outfeed vacuum starwheel 13B removes finished containers FC (FIG. 4B) from the apparatus for delivery to a removal conveyor (not shown).

Figure 1C:
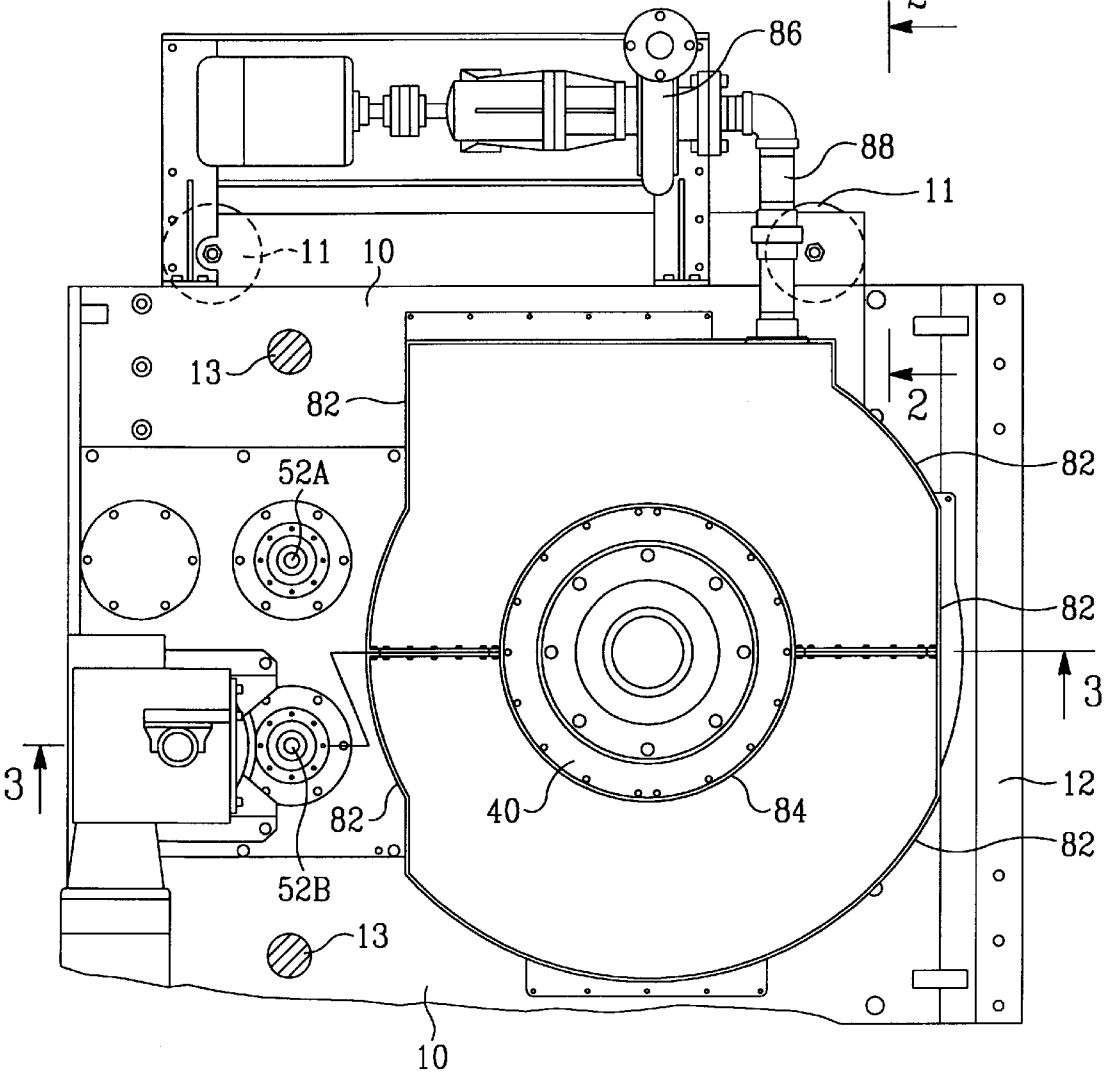
FIG. 1C is a top plan view of the base and workfluid reservoir portions of the preferred embodiment of the invention.

The lower portion of column 11C comprises a large diameter cylindrical component 16 is above which a conical surface 16A and a smaller cylindrical portion 16B are provided as shown in FIG. 3. A planar radial surface 16C supports a rotary bearing 17 as best shown in FIGS. 1 and 3. Cylindrical surface 16D engages the interior of bearing 17. The cylindrical portion 16D' of the lower component 16 immediately above surface 16D is of slightly less diameter than the diameter of surface 16D. The upper portion of component 16 has an axial opening threaded at 19. Upper end surface 16E is engaged by downwardly facing radial surface 24 of a middle column component 20 best illustrated in FIG. 12.

The middle column component 20, has a threaded lower end portion 22 which is threaded in internal threads in bore 19 of the upper portion 16C of lower column component 16. Middle column component 20 also includes a central threaded portion 26, an enlarged diameter component 21 and an upper end surface 23 which is unitarily connected to an upper column component 27 by welding.

Figure 12:
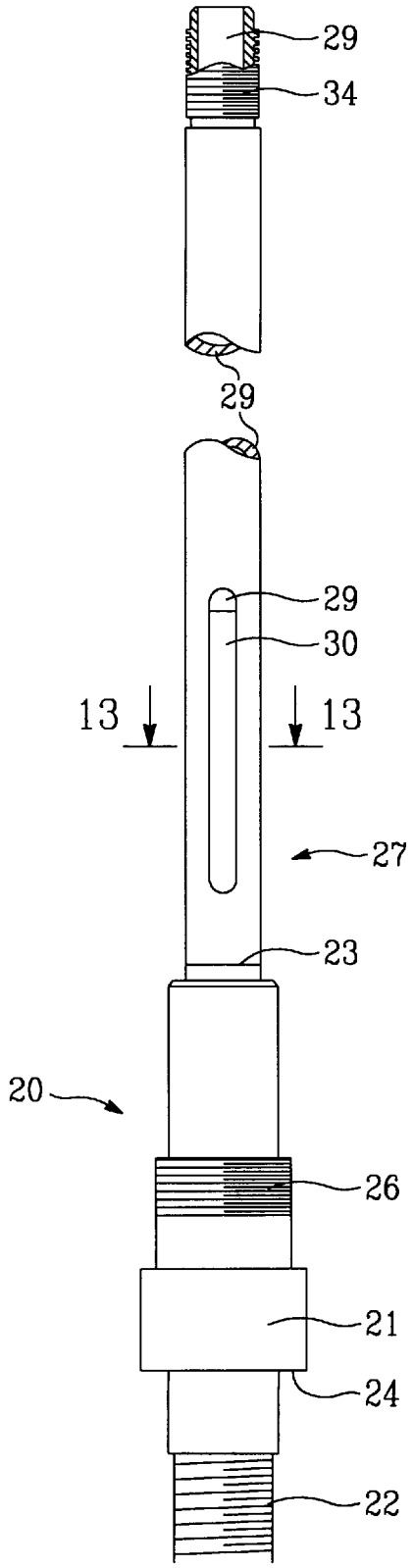
FIG. 12 is a front elevation of the uppermost components of the main support column.
Figure 13:
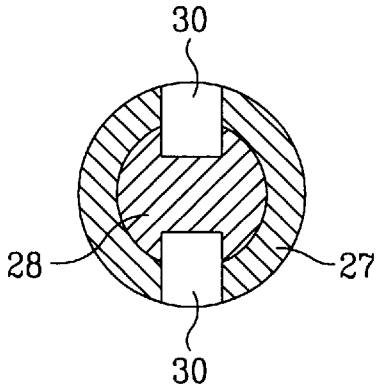
FIG. 13 is a section view taken along line 13—13 of FIG. 12.

Upper column component 27 has an axial high pressure workfluid bore 29 extending downwardly from the upper end of upper column component 27 to an internal core member 28 (FIG. 13). Axially extending diametrically opposed slots 30 extend through column component 27 into core member 28 and communicate with workfluid bore 29 at their upper ends as shown in FIG. 13. The upper end of the component 27 is provided with external threads 34 as shown in FIG. 12.

All of the aforementioned support column components 16, 20, 27 etc. are fixedly positioned and provide support for multiple rotary components mounted for rotation on the column about the vertical axis of the column.

More specifically, a thrust bearing 36 is supported on annular base plate 14 and is co-axial with respect to the lower end portion of the column 16 as shown in FIG. 3. Thrust bearing 36 provides support for a lower cylindrical rotary support sleeve 38 which is mounted for rotation coaxially with respect to the column components 16, 20 and 27.

An annular rotary flange 40 is welded to the lower end of lower rotary support sleeve 38 and in turn provides support for a main drive gear 42 which is connected to annular rotary flange 40 by machine crews 44 (FIG. 3). Main gear 42 is covered by a main drive gear cover formed of two connected sections 43A and 43B as shown in FIG. 4, is meshes with intermediate gear 48 which is driven by a pinion gear 50. Pinion gear 50 is driven by a lower output shaft 54 of a step-down transmission 56 receiving input drive from a motor 58. Step-down transmission 56 also includes an upper output drive 60 which drives position signal generating means 61 indicative of the position of the main gear 42 for timing of other operations that must be synchronized with the precise rotary position of the main drive gear 42 and the equipment rotated by main drive gear 42.

It should also be noted that intermediate gear 48 is drivingly connected to outfeed drive means 52B shown in FIG. 3. Outfeed drive means 52B operates to drive a vacuum outfeed starwheel 13B. Similarly, an infeed drive means 52A for an infeed vacuum starwheel 13A is drivingly connected to main gear 42 in exactly the same manner as outfeed drive means 52B, through an intermediate infeed drive gear 48' identical to gear 48, and which meshes with main gear 42 in the same manner as gear 48.

Figure 9:
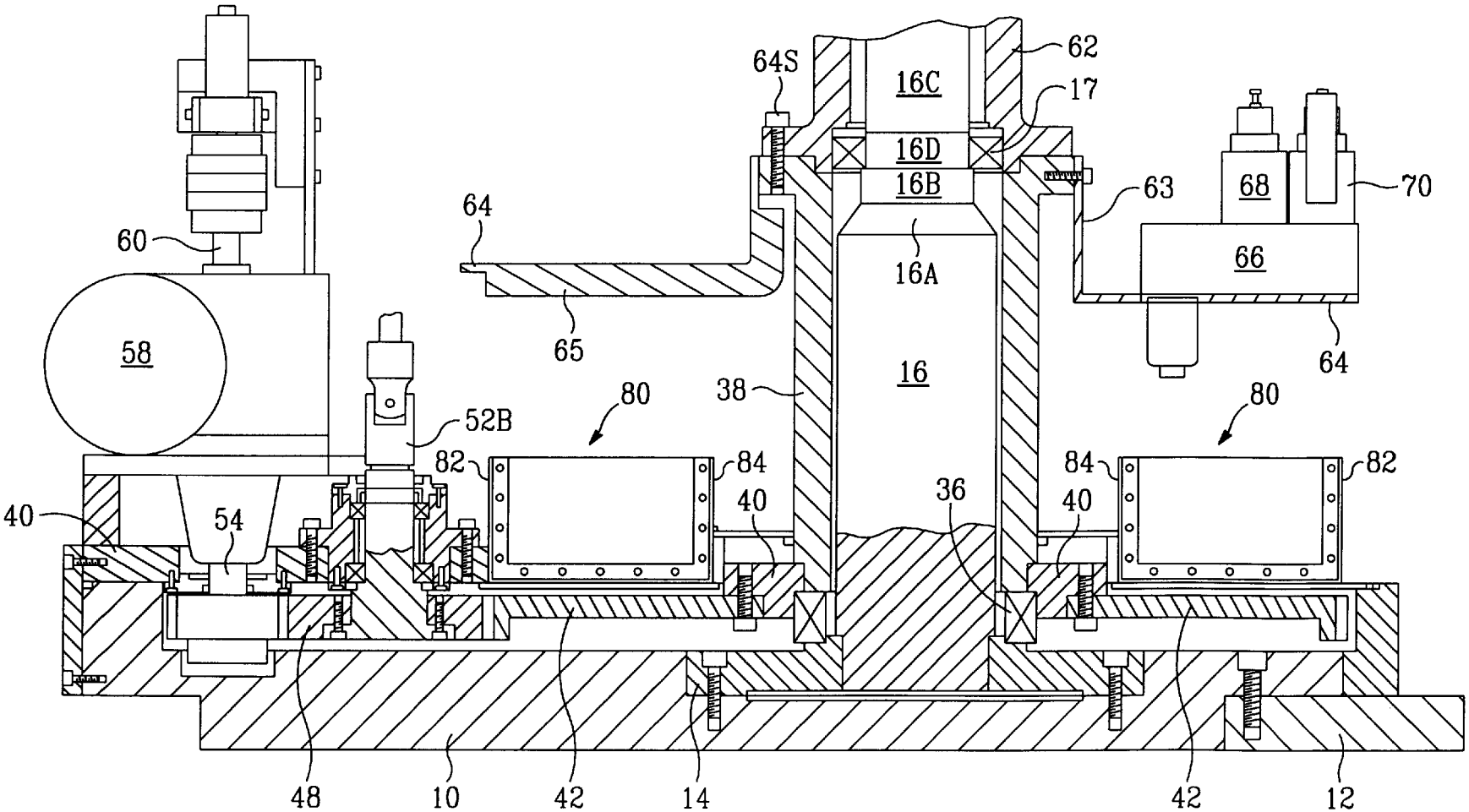
FIG. 9 is a section view taken along line 9—9 of FIG. 8.
Figure 41:
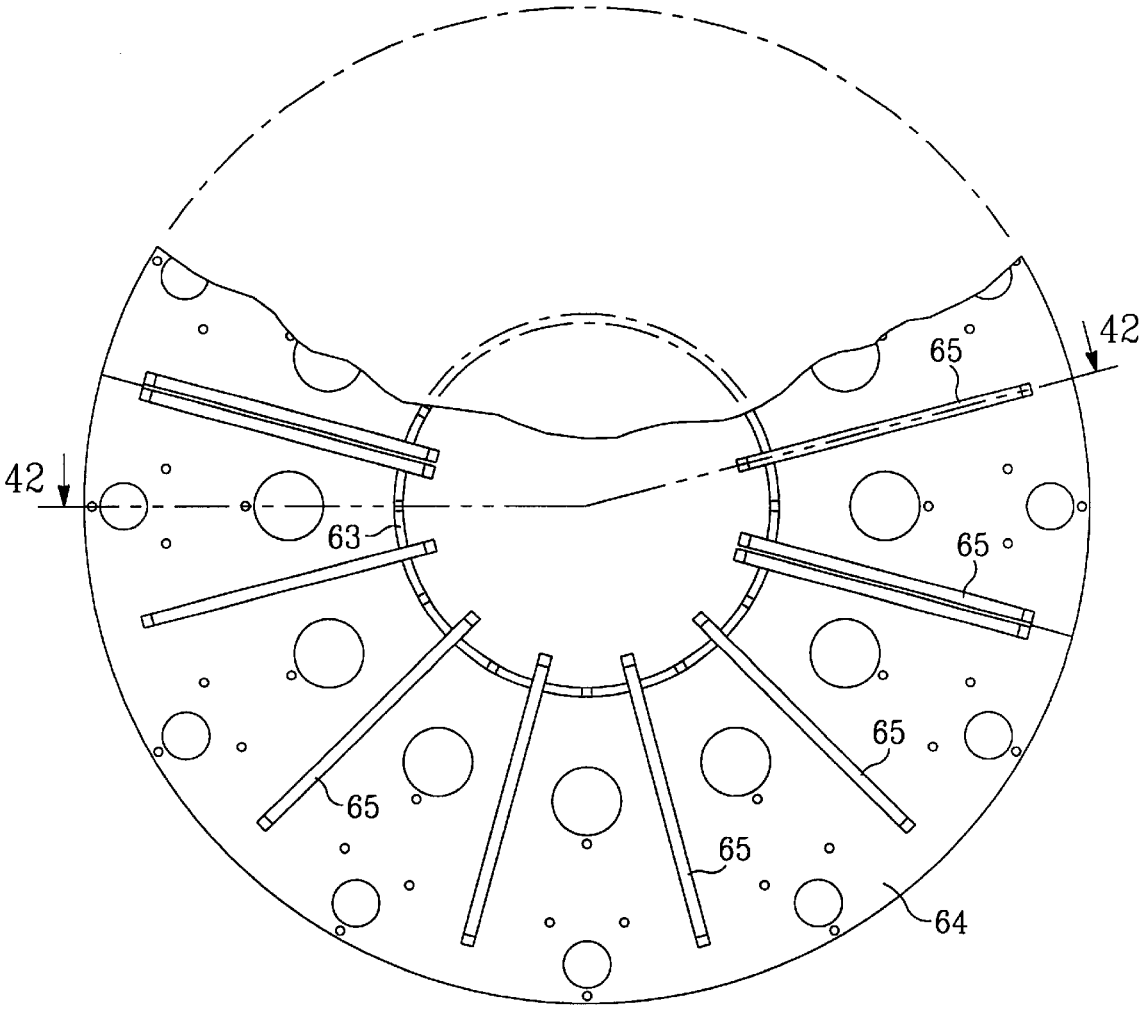
FIG. 41 is a bottom plan view of the rotary wand valve control table.
Figure 42:
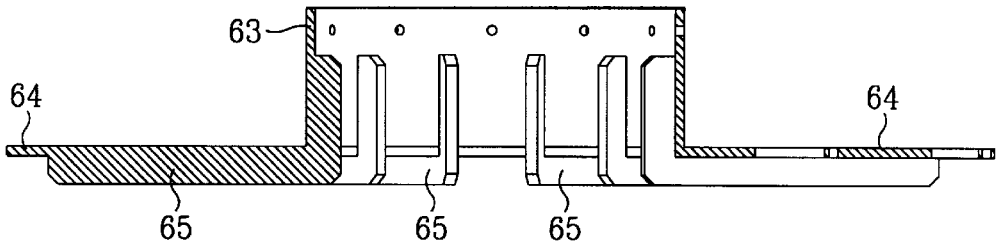
FIG. 42 is a section taken along line 42—42 of FIG. 41.

A second vertical rotary support sleeve 62 is connected by machine screws 64S to the upper end of the lower rotary support column 38 with which it is axially aligned as shown in FIGS 1A and 3. Additionally, a horizontal wand control valve support table 64 is also connected to the upper end of the lower tubular support column 38 as shown in detail in FIGS. 1A and 9. Valve support table 64 includes a hub 63 and a plurality of L-shaped radially extending flanges 65 as best shown in FIGS. 9, 41 and 42. Control valve blocks 66 are mounted on support table 64 with each valve block including an electrically controlled high pressure workfluid supply solenoid valve 68 which receives high pressure workfluid from the downstream end of a high pressure workfluid supply line 248 connected at its upstream end to a high pressure rotary union 246 (FIG. 14).High pressure workfluid supply solenoid valve 68 when opened supplies high pressure workfluid to wand means 160 (FIG. 23) by means of a high pressure rotary coupling 219.

Figure 31:
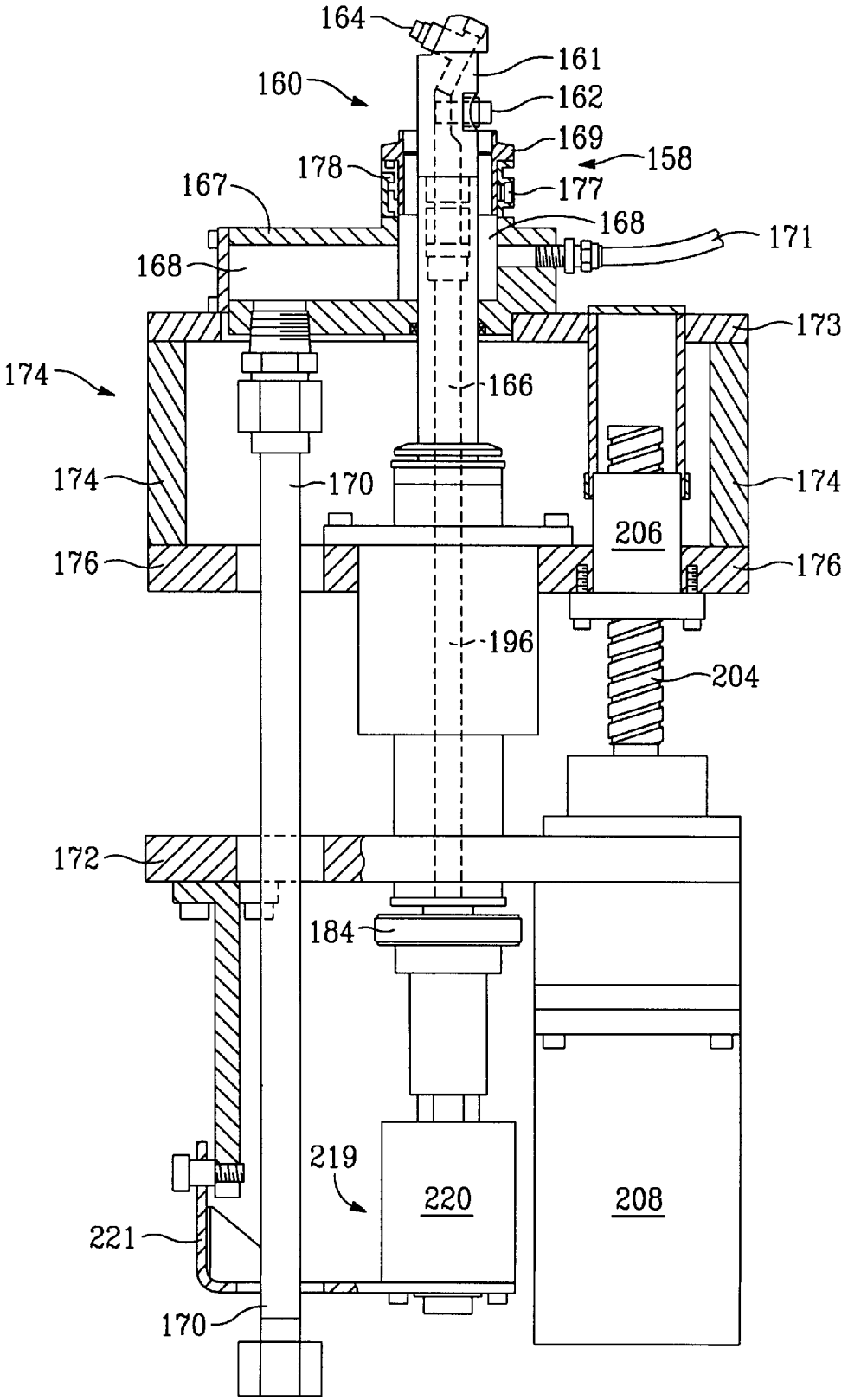
FIG. 31 is a view taken along line 31—31 of FIG. 25.
Figure 31A:
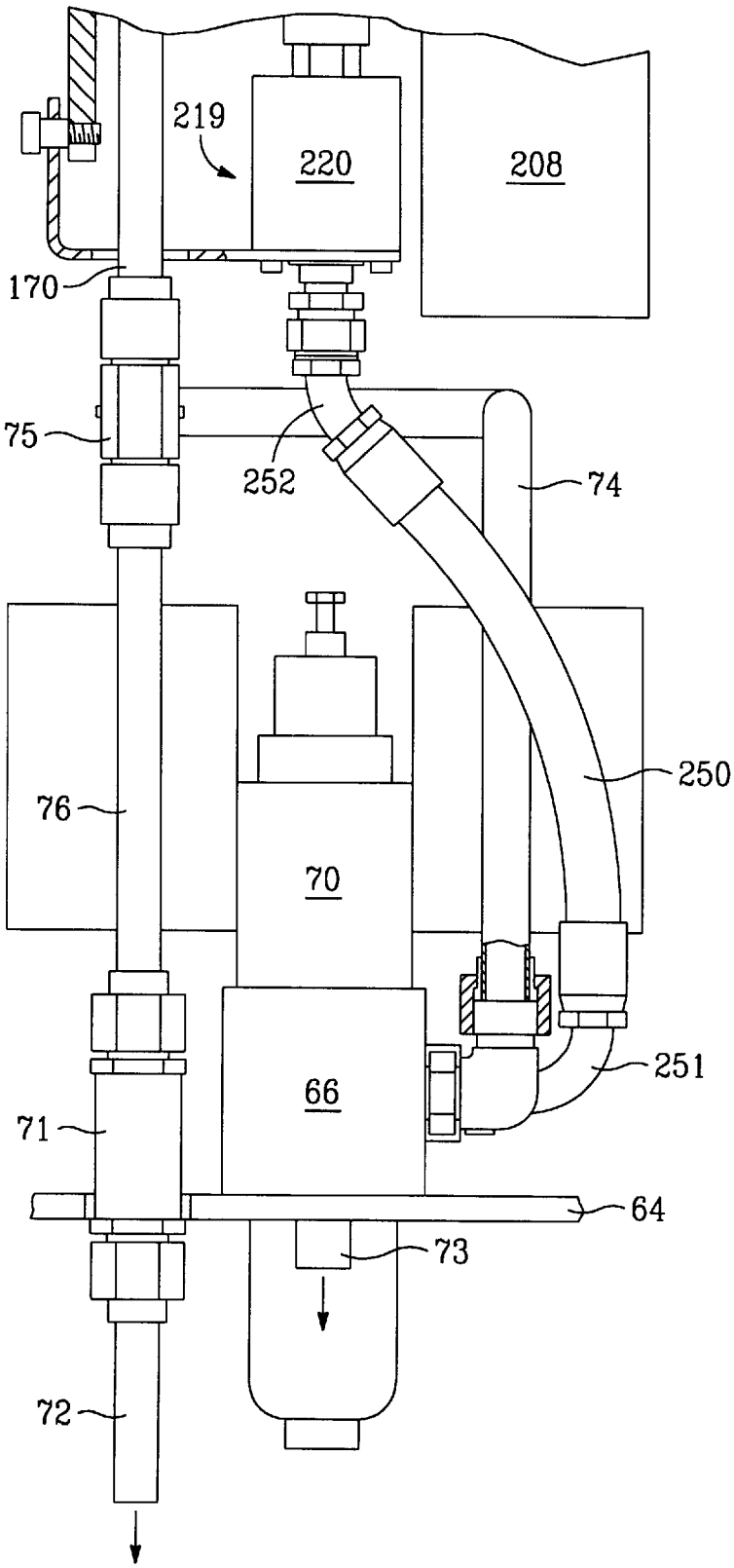
FIG. 31A is a view similar to FIG. 31 but additionally illustrating details of the workfluid handling components of the invention.

An electrically controlled workfluid return solenoid valve 70 is also mounted in each control valve block 66 and is connected to a workfluid drain line 170 (FIG. 31) for opening at the completion of a can wall forming cycle to effect discharge of excess workfluid from the interior of the can and mold support into an exhaust tube 73 shown in FIG. 31A. The inlet of workfluid return solenoid valve 70 is connected to drain line 170 by an offset line 74 connected to the radial outlet of a T-fitting 75 which is connected to the lower end of drain line 170.

A lower drain line 76 extends from T-fitting 75 to the inlet of a mechanical pressure relief check valve 71 which communicates with the interior of the workpiece WP in the mold through drain line line 76, fitting 75, line 170 and an interior drain chamber 168 (FIGS. 23 and 31) and opens in response to pressure in the workpiece exceeding a predetermined value. Such opening of check valve 71 permits the air pressure in the workpiece to forcefully discharge spent workfluid from a workpiece being shaped by the apparatus. The spent workfluid is discharged into a fixedly positioned annular workfluid reservoir 80 by exhaust line 72 as shown in FIGS. 1A and 31A. In the preferred embodiment, a relief pressure of 40 psi for opening pressure relief check valve 71 has been found to provide optimum results. Fixedly positioned workfluid reservoir 80 is located above gear cover 43A, 43B and has an outer wall 82 and an inner wall 84 which surrounds the lower end portion of the column component 16 and the surrounding tubular support column 38 as best shown in FIG. 1A and FIG. 3.

Figure 8:
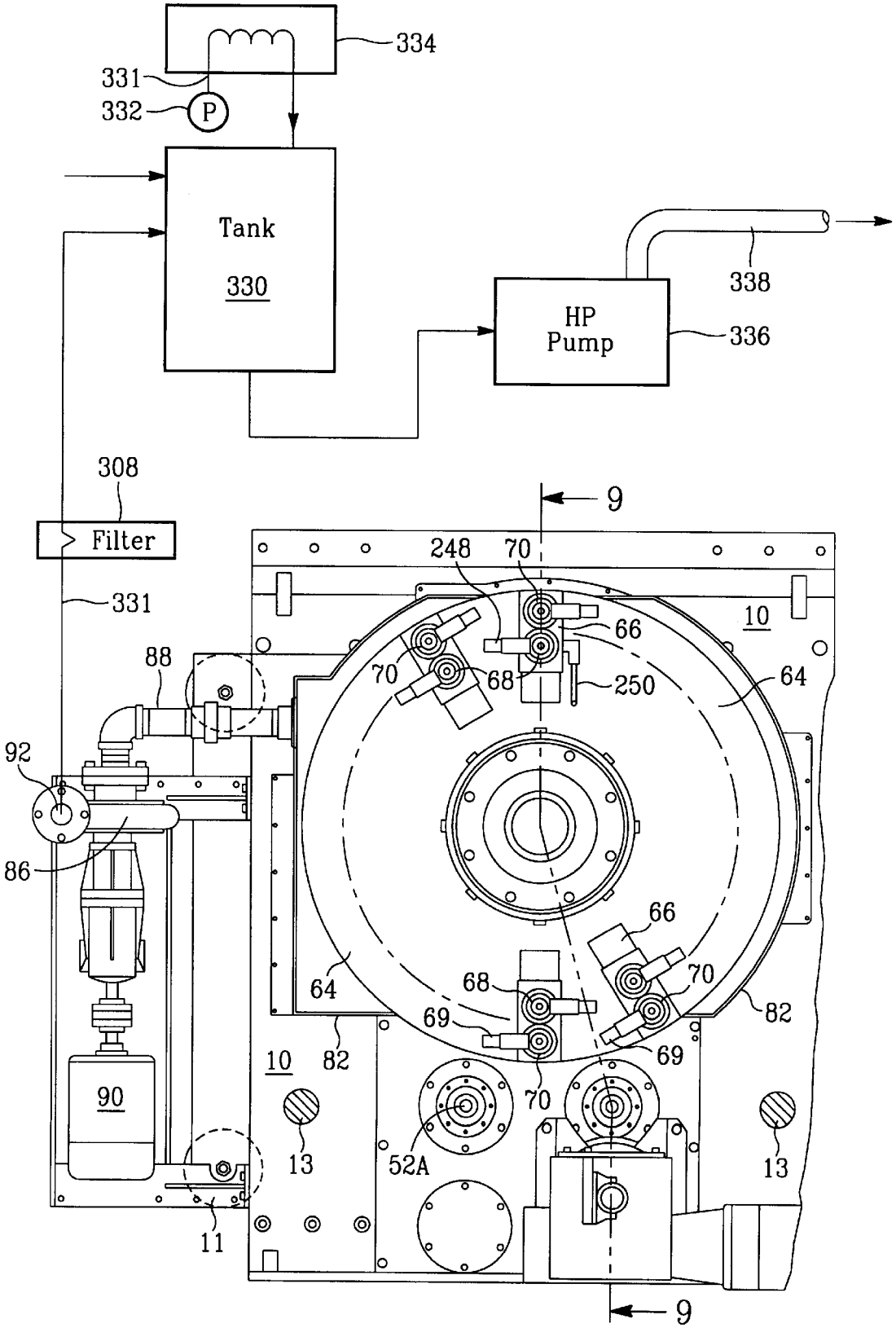
FIG. 8 is a plan view of the wand hydraulic control valve and its support table and the lowermost rotary support table on which it is mounted.
Figure 43:
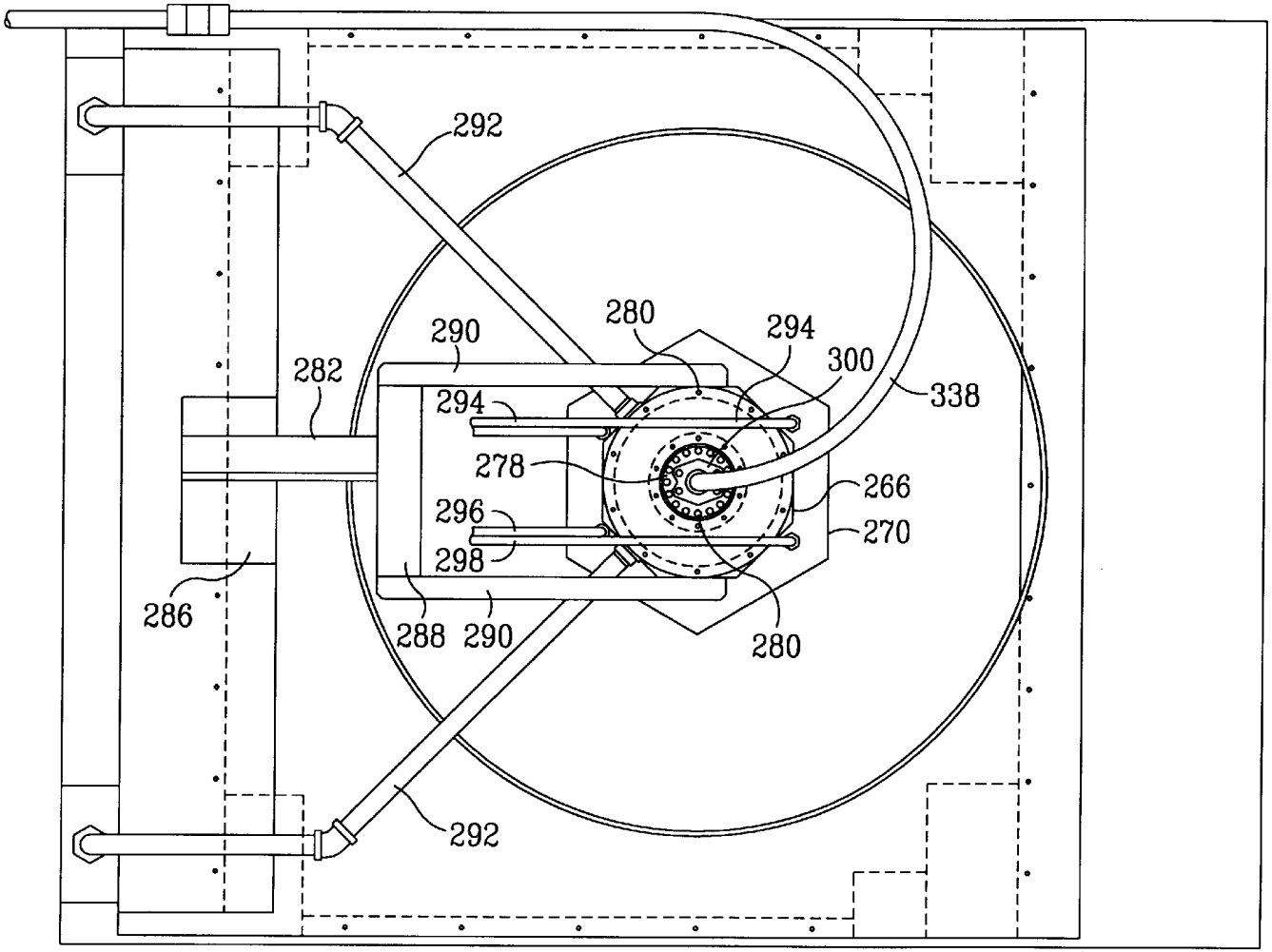
FIG. 43 is a top plan view of the preferred embodiment.
Figure 54:
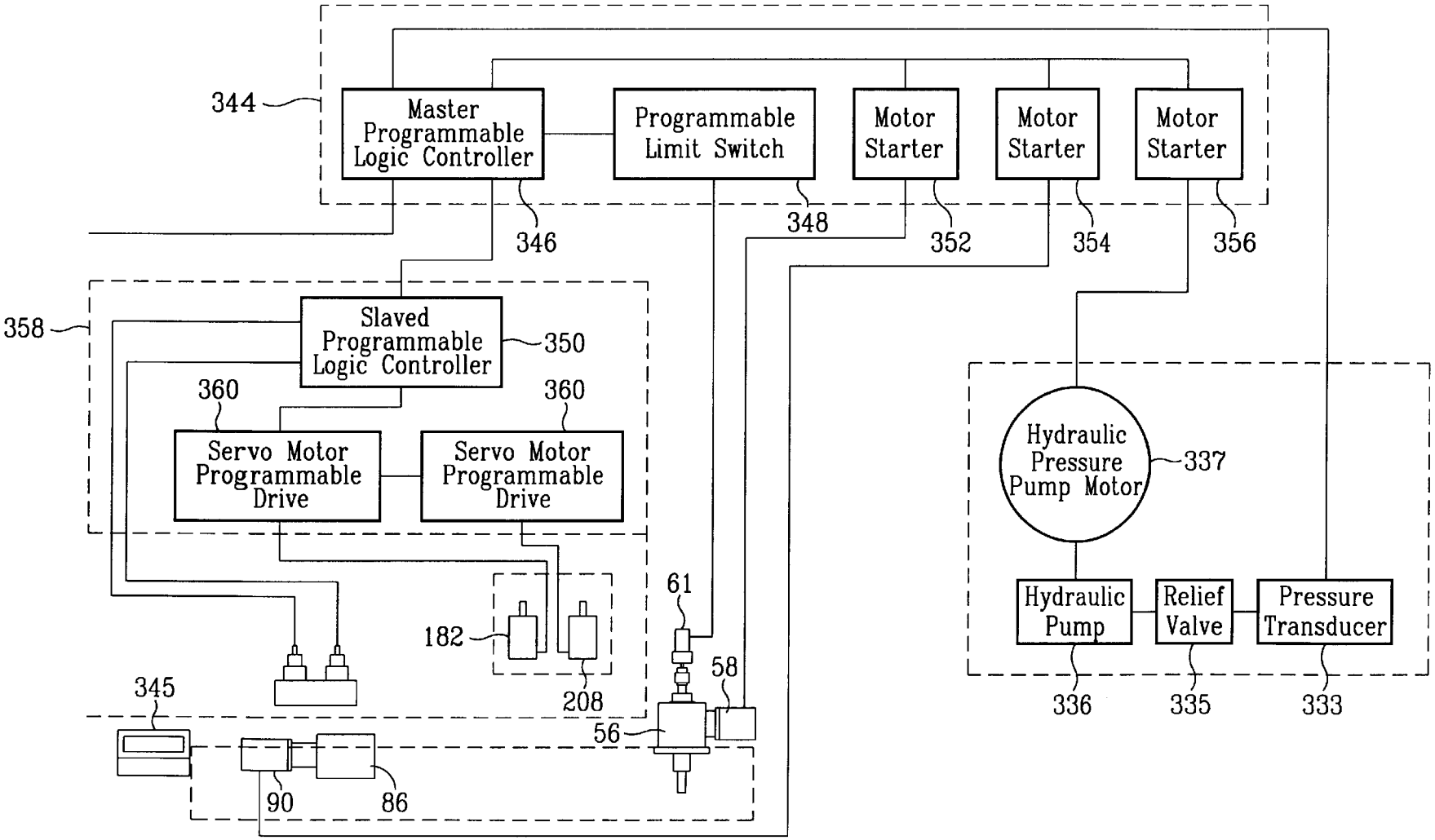
FIG. 54 is a flow chart illustrating the relationship of the controlled elements and the control means of the preferred embodiment of the invention.

A centrifugal water return pump 86 driven by electric motor 90 has an inlet connected by conduit 88 to the workfluid reservoir 80 for removing spent workfluid from reservoir 80 and pumping it through a filter 308 to a storage tank 330 as shown in FIG. 8. Workfluid in tank 330 is cooled to approximately 80 degrees Fahrenheit by circulation through a heat exchanger 334 effected by operation of circulation pump 332 in circulation pump line 331. High pressure pump 336 is controlled by a manually adjustable relief valve 335 and a pressure transducer 333 connected to control circuitry in a power distribution and control enclosure 344 as shown in FIG. 54. The workfluid is removed from tank 330 by high pressure pump 336 by operation of high pressure pump motor 337 and pumped into a high pressure delivery line 338 which is connected at its downstream end to water supply axial bore 29 in the support column as shown in FIGS. 1B and 43. Workfluid in bore 29 is subsequently delivered to plural workstations in a manner to be discussed below.

Figure 14:
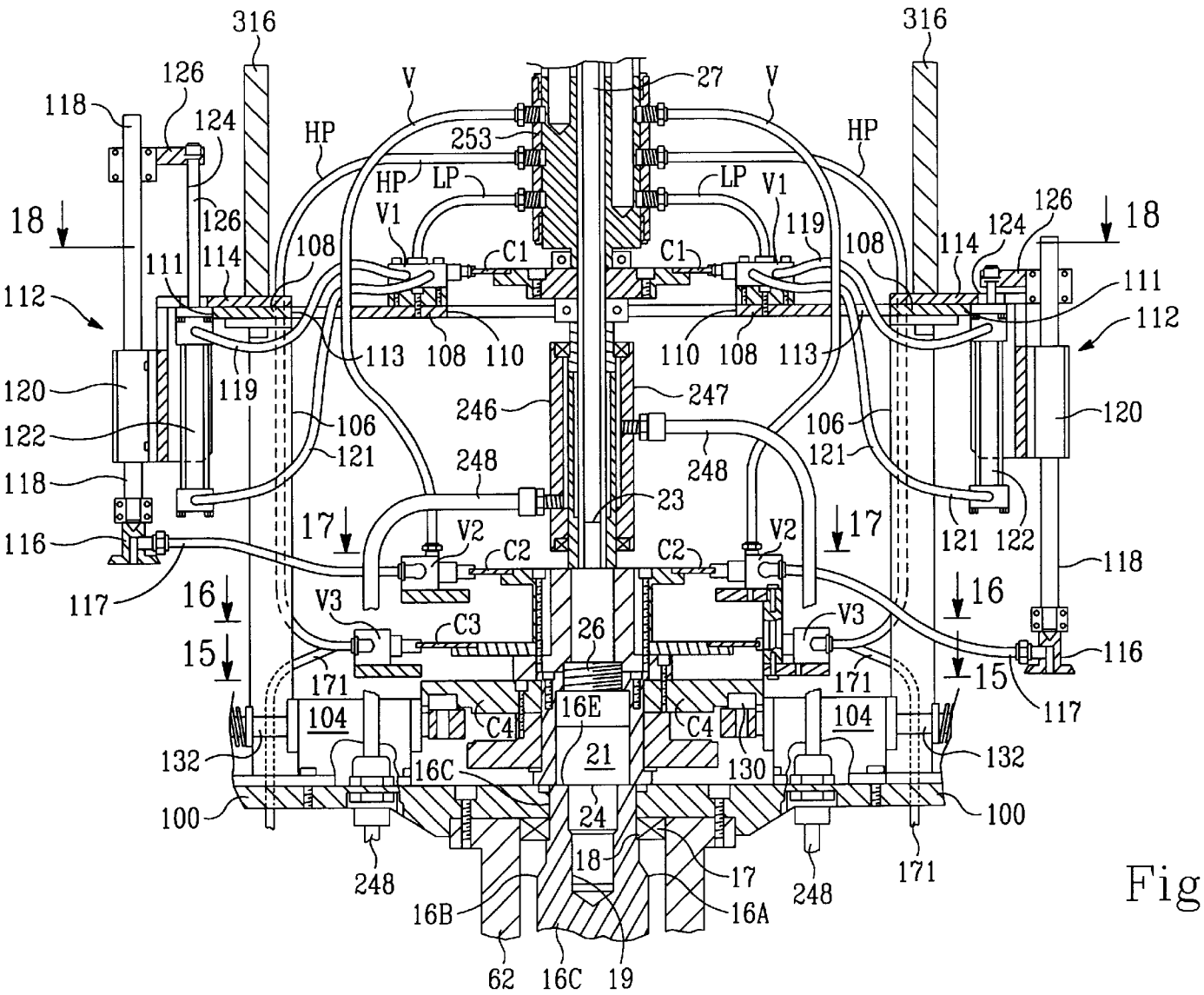
FIG. 14 is a bisecting sectional view illustrating the structure immediately above that shown in FIG. 9 including the juncture of the uppermost lowermost components of the support column.
Figure 15:
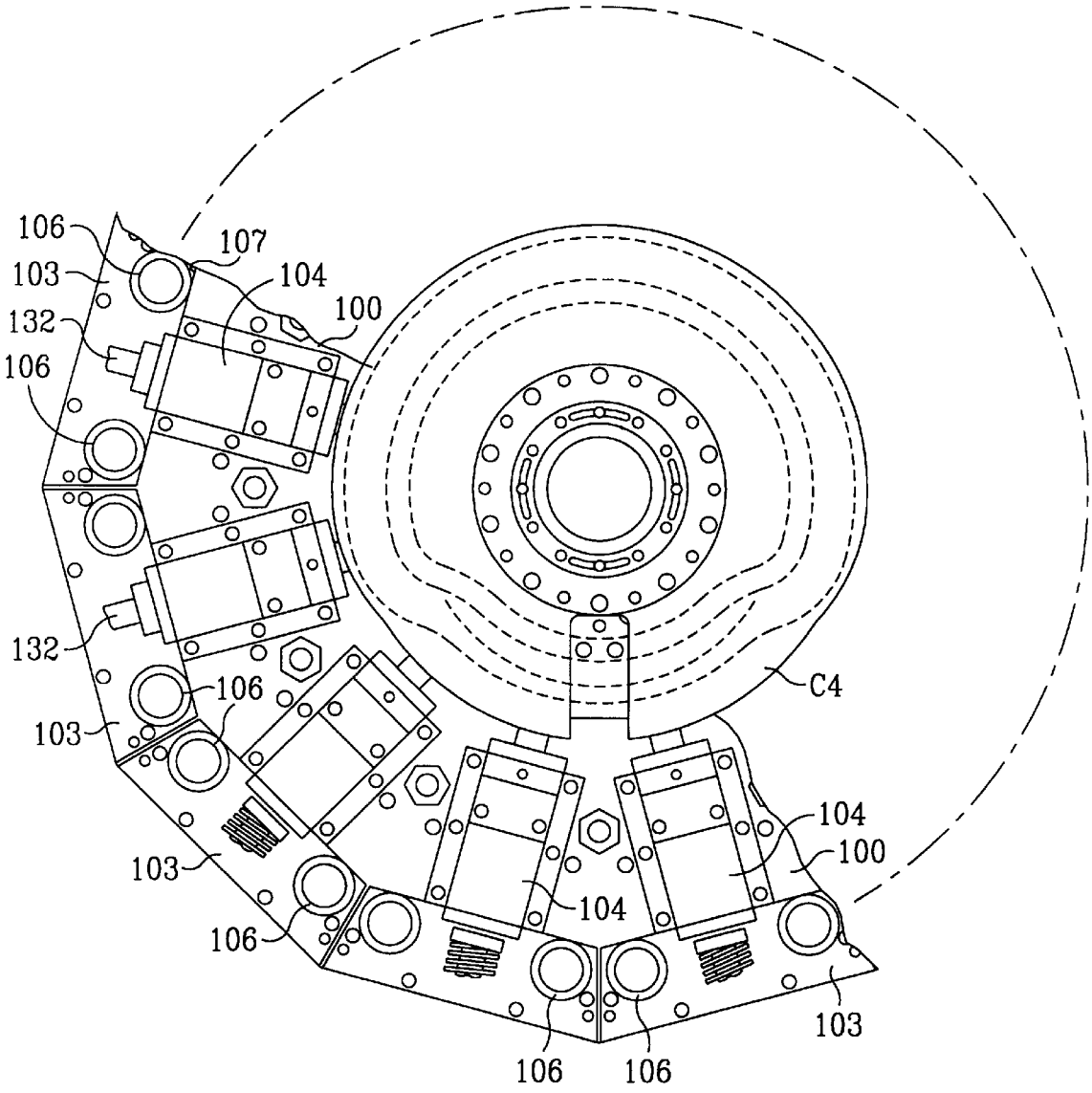
FIG. 15 is a section view taken along line 15—15 of FIG. 14.

The upper end of the second level tubular support sleeve 62 supports a rotary mold support table 100 as best shown in FIG. 14. Twelve workstations 102 are equidistantly positioned about the periphery of rotary mold support table 100 with three of the work stations 102A, 102B and 102C being illustrated in FIG. 34. Each work station 102 includes a circular wand receiving opening 101 and an access port 103 formed in table 100 as shown in FIG. 38. Additionally, a reduced thickness peripheral portion 105 in (FIG. 35) table 100 defines the outer extent of the table and has an inward boundary defined by chordal stop surface 107 (FIGS. 38 and 39). A positioning plate 103 is provided on the upper surface of table 100 in each workstation. Plate 100 receives the lower ends of vertical standards 106. A mold support plate 109 (FIG. 34) having side edges 111 and a wand access opening defined by surface 101 aligned with wand receiving opening 101 is mounted for limited radial sliding movement on the reduced thickness peripheral portion 105 between a retracted position shown in workstation 102A and an extended outer position assumed when the mold is in closed condition as shown in workstations 102B and 103C of FIG. 34.

Figure 24:
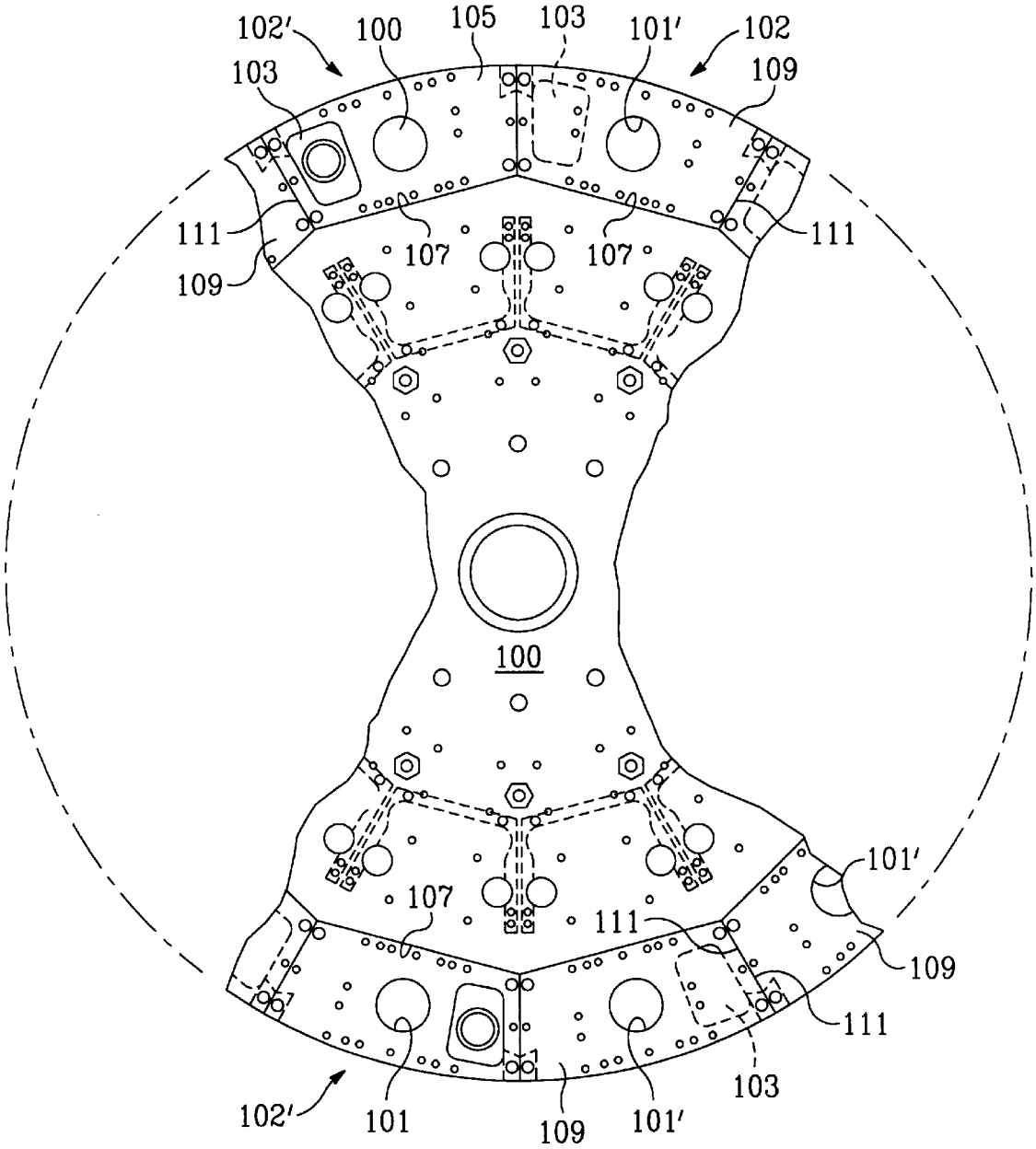
FIG. 24 is a top plan view of the middle rotary mold support table shown in section in FIG. 23.
Figure 30:
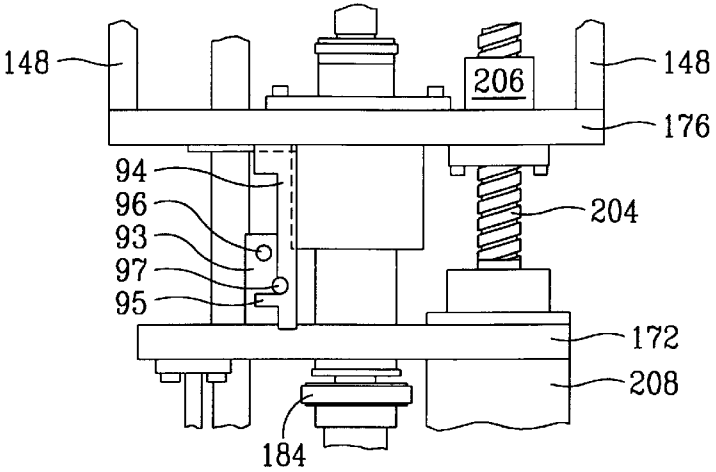
FIG. 30 is a view taken along line 30—30 of FIG. 26.
Figure 25:
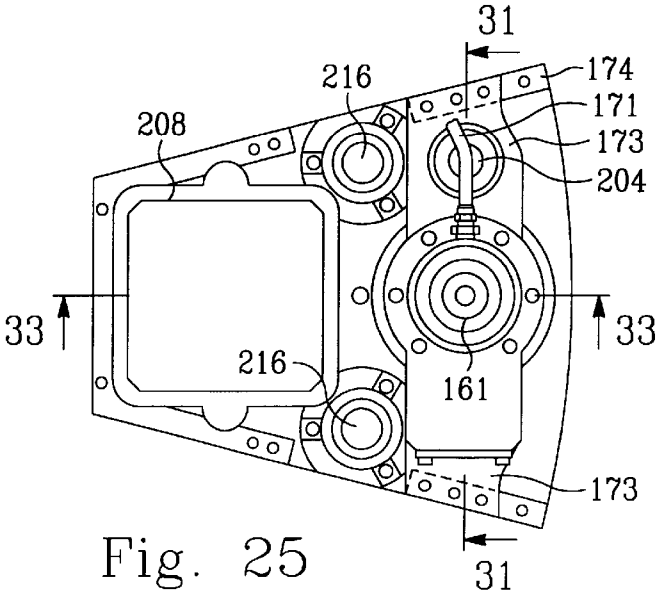
FIG. 25 is a top plan view of a wand and the lower end portion of the workstation components immediately beneath the mold means.
Figure 26:
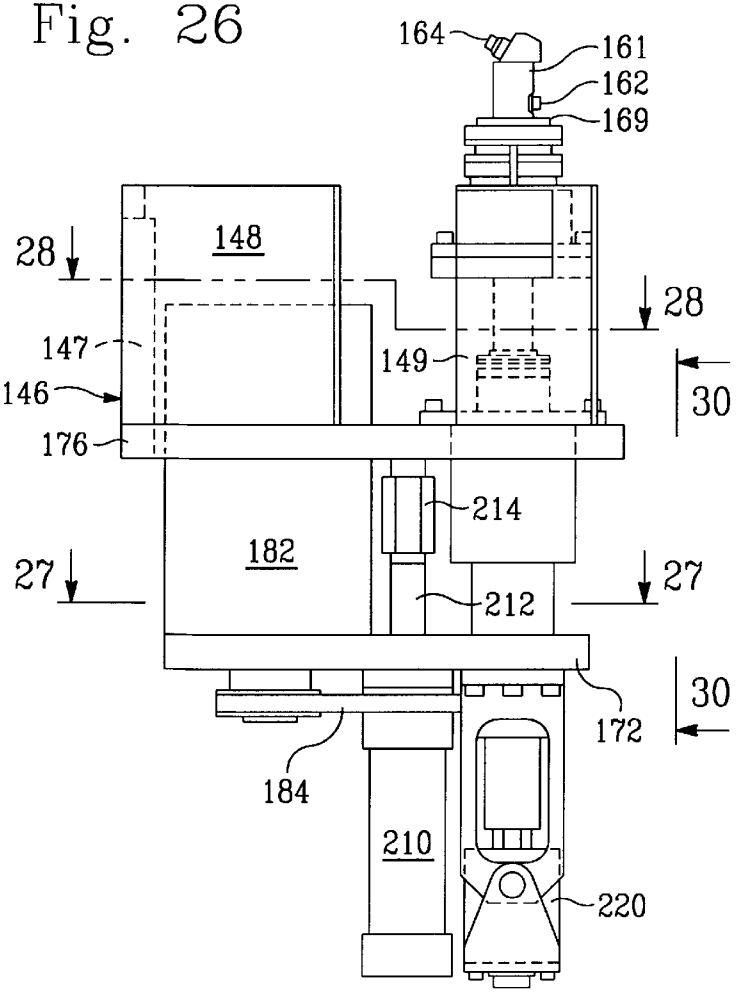
FIG. 26 is a front elevation of the wand assembly of FIG. 25.

Workstations 102' in FIG. 24 are shown without mold support plates being positioned in such workstations on support table 100. Mold support plates 109 are provided in workstation 102 of FIG. 24. A slide bearing housing 104 is mounted inwardly of plate 103 on table 100 in each workstation with two of the slide bearing housings 104 being shown in FIG. 14 and others being shown in FIG. 34.

Figure 18:
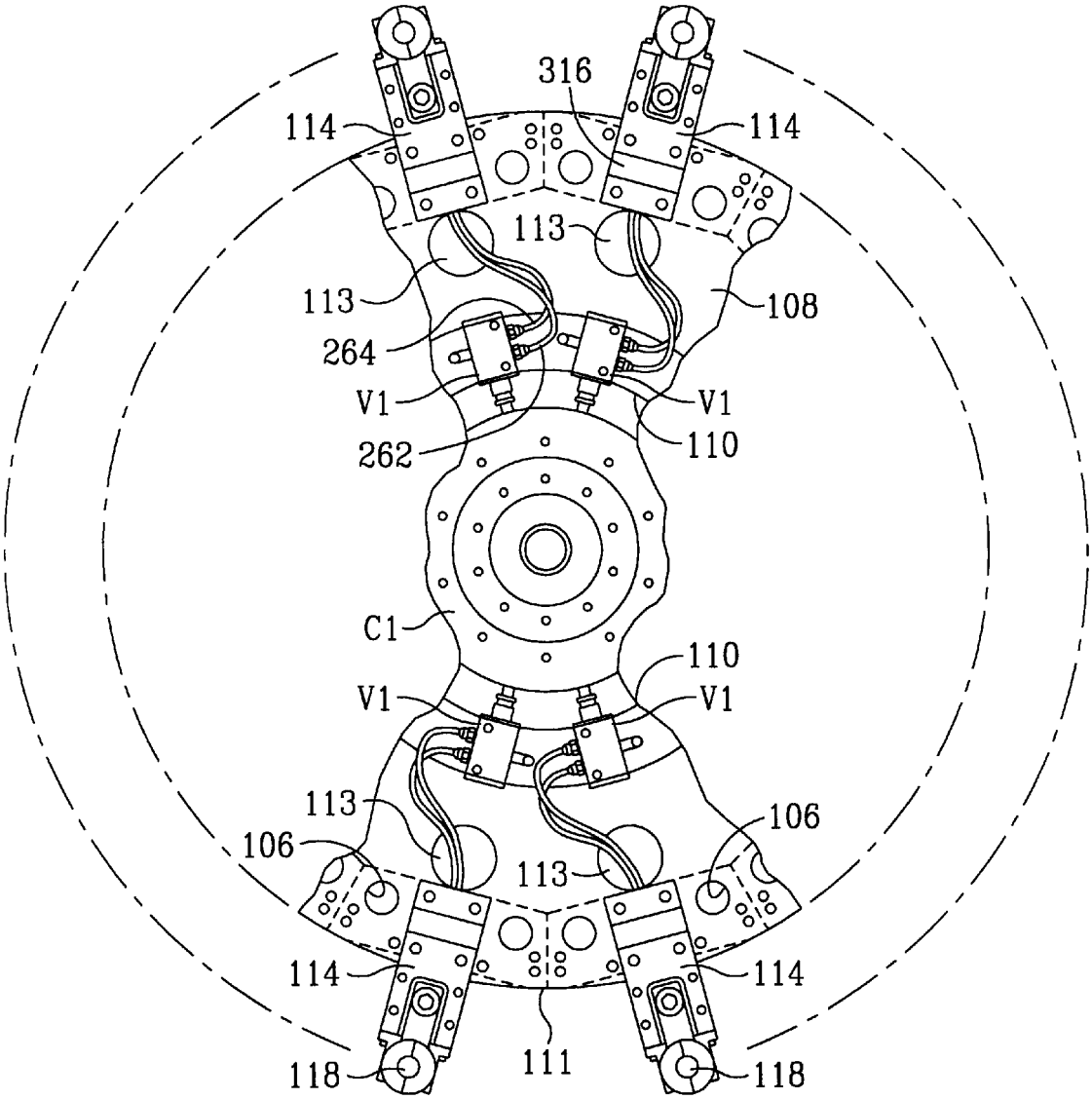
FIG. 18 is a section view taken along line 18—18 of FIG. 14.

Two tubular vertical standards 106 extend upwardly from each standard receiving plate 103 of each workstation on table 100 and support an annular rotary support table 108 at their upper ends so that tables 100 and 108 rotate in unison. The inner extent of annular rotary table 108 is defined by a cylindrical surface 110 as best shown in FIGS. 14 and 18 and the outer periphery of support table 108 is defined by an outer cylindrical surface 111 also shown in FIG. 18. A circular aperture 113 is provided in each workstation in rotary support table 108 for permitting the passage of vacuum lines therethrough.

Each workstation includes a workpiece transfer mechanisms generally designated 112 positioned about the outer periphery of annular rotary table 108 with two of the transfer mechanisms 112 being shown in FIG. 14. Each of the transfer mechanisms includes a suction head 116 in vertical alignment with a mold 134 when the mold is in its outermost position. The suction head has a vertical axis which orbits the support column in a circular path 366 shown in FIG. 52.

Figure 52:
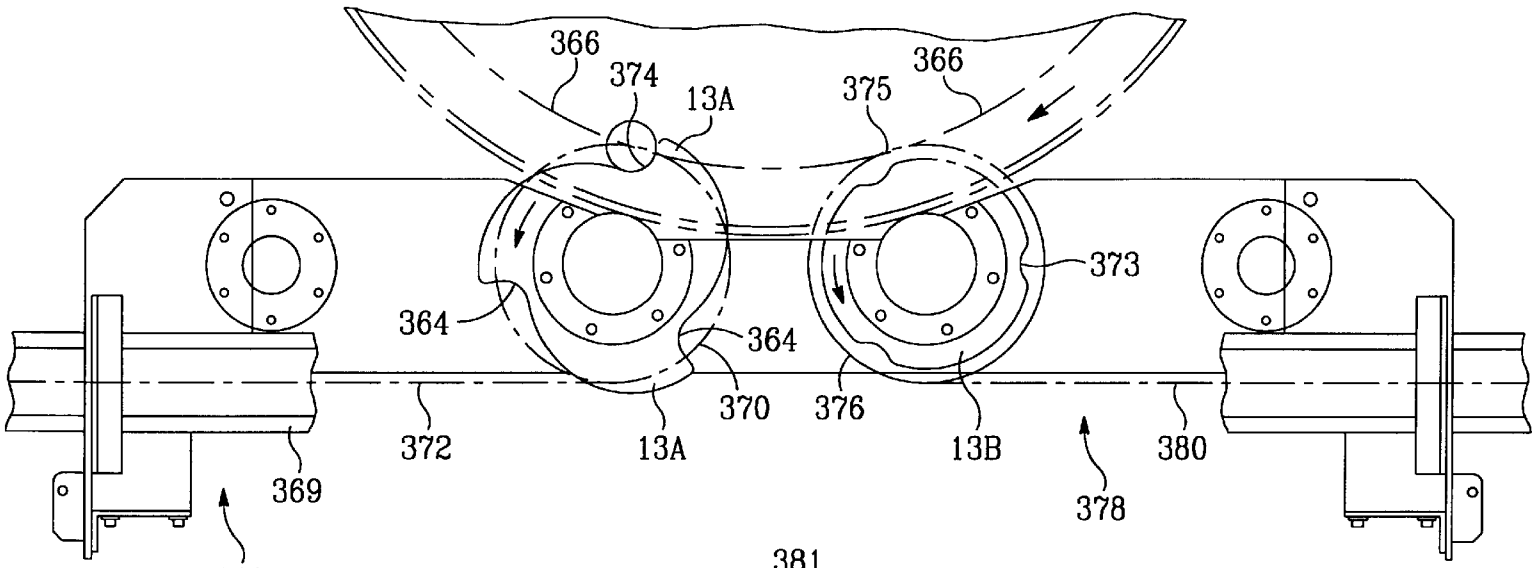
FIG. 52 is a top plan view of the pneumatic infeed and outfeed conveyors and the associated infeed and outfeed vacuum starwheels of the preferred embodiment.
Figure 53:
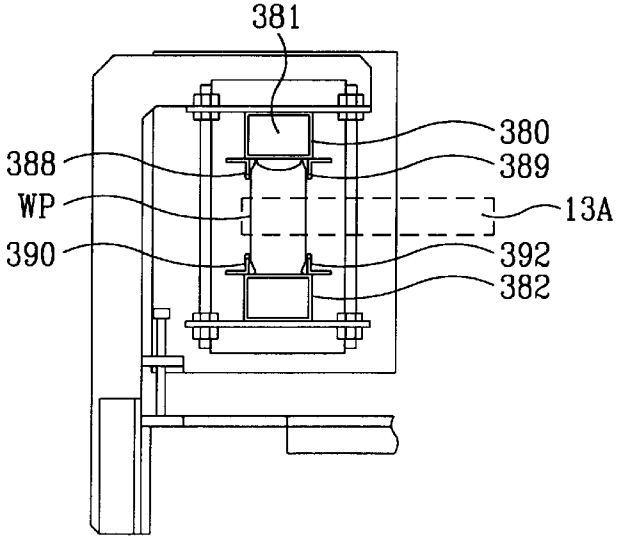
FIG. 53 is an end elevation of the structure shown in FIG. 52.

A conventional air actuated conveyor 368, FIGS. 52 and 53, of the type manufactured by Conveyor Systems Incorporated has an infeed portion 369 which feeds workpieces WP to infeed starwheel 13A and an outfeed conveyor portion which receives finished containers FC from outfeed statwheel 13B. The centerline axis of each workpiece WP being fed by the infeed portion 369 of the conveyor travels along linear infeed path 372 until it is engaged by one of the workpiece receiving pockets 364 of infeed starwheel 13A. Each workpiece received in a pocket 364 of the infeed starwheel 13A is held in position by vacuum openings in the receiving pocket 364 and has its centerline axis travel along circular path 370 up to transfer point 374 at which the circular path 366 of suction head 116 and path 370 overlie each other as shown in FIG. 52. The vacuum in the infeed starwheel 13A is disconnected from the workpiece when the workpiece arrives at transfer point 374 to permit one of the suction heads 116 to engage and retain the workpiece for rotation of the centerline of the workpiece along circular line 366 to an outfeed transfer point 375.

Similarly, outfeed starwheel 13B carries finished containers FC in container receiving peripheral pockets 373 along a circular path 376 from a transfer outfeed point 375 to the outfeed conveyor portion 378 which removes the finished containers along outfeed linear removal feedpath 380. The conveyor has an upper workpiece guide 381(FIG. 53) having a drive air plenum in which pressurized drive air is provided and a lower workpiece guide 382 having a drive air plenum 383. Drive air in each plenum is directed through openings in the plenums to apply air jets to the workpieces in well known manner to feed the workpieces (and finished containers)from left to right as viewed in FIG. 3. Upper guide rails 388 and 389 and lower guide rails 390 and 392 guide the workpieces and finished containers along the infeed and outfeed portions of the air conveyor 368. However guide rails 389 and 392 terminate upstream of infeed vacuum starwheel 13A and downstream of outfeed starwheel 13B to provide an opening which permits removal and insertion of workpieces relative to the conveyor by means of the vacuum starwheels which extend into the interior of the conveyor as shown in FIGS. 52 and 53.

Suction head 116 engages a workpiece WP on the infeed vacuum starwheel 13A and removes it from the starwheel following which the workpiece WP is lowered into the open mold by the transfer mechanism for shaping of the wall of the workpiece. Upon completion of the shaping, the finished container FC is lifted from the mold and positioned in the outfeed vacuum starwheel 13B by suction head 116 for removal from the apparatus.

Each of the transfer mechanisms 112 comprises a support bracket 114 attached to the upper surface of table 108 and extending radially beyond the outer periphery 111 of the table as shown in FIGS. 14 and 18. The selectively operable vacuum suction head 116 is mounted on the lower end of a cylindrical slide rod 118 mounted for reciprocation in a slide bearing 120 supported by bracket 114. A piston rod 124 of suction head positioning cylinder 122 is fixedly connected to bracket 114 and a bracket 126 connects slide rod 118 to piston rod 124 as shown in FIG. 14.

Figure 11:
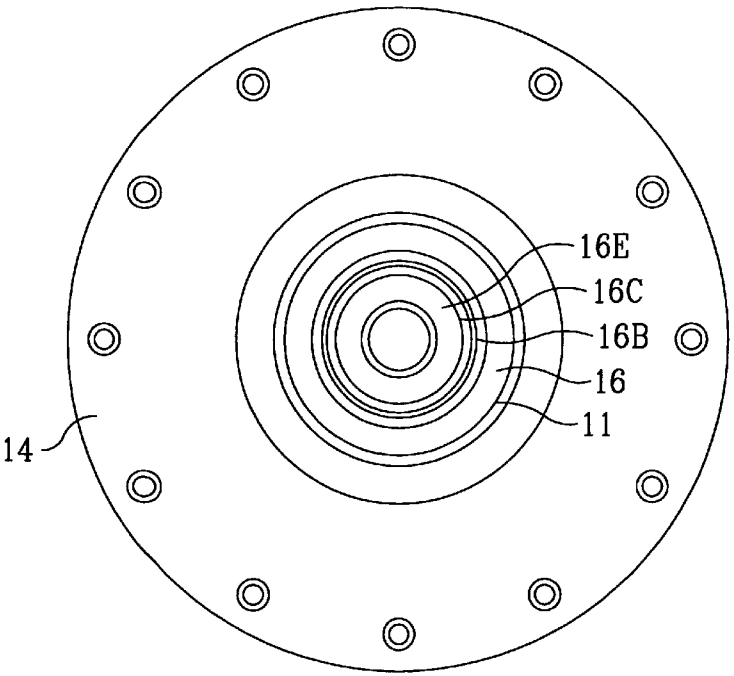
FIG. 11 is a top plan view of the lowermost component of the main support column of FIG. 10.

It should be noted that the suction head positioning cylinder 122 on the left side of FIG. 14 is illustrated in an extended position in which the vacuum head 116 is elevated above the position of the vacuum head 116 on the right side of FIG. 14. The lower position of the right vacuum head represents the position of the vacuum head when it is positioning a workpiece in mold means 134 provided in each workstation. The elevated position of the vacuum head shown on the left side of FIG. 11 is the transit position for receiving and delivering workpieces to and from the vacuum infeed and outfeed starwheels. Transfer of workpieces WP and finished containers FC between the starwheels and mold 134 is effected with the suction head in the elevated position.

The portion of the support column extending above mold support table 100 provides support for fixedly positioned cams C1, C2, C3 and C4 illustrated in FIG. 14. From top to bottom, these cams comprise a low pressure air control cam C1 for controlling the operation of the suction head positioning cylinder 122, a vacuum control cam C2 for timed provision of vacuum to suction heads 116, a purge control cam C3 for providing and controlling high pressure air to the interior of workpieces in the mold, and a mold control cam C4 for mechanically opening and closing mold members 134 provided in each workstation.

Twelve low pressure air valves V1(FIG. 14) are provided equidistantly from each other for rotation about the periphery of low pressure air control cam C1 with each valve V1 controlling one of the suction head positioning cylinders 122 of one of the infeed and outfeed mechanisms 112. Each low pressure air valve V1 has an internal valve spool operated by cam C1 for movement between two positions in one of which positions low pressure air is provided to the lower or head end of the cylinder 122 so that cylinder 122 is extended as shown on the left side of FIG. 14. Similarly, in the second position of the valve spool, each air valve V1 vents the lower end of cylinder 122 and supplies low pressure air to the upper or rod end of cylinder 122 so that cylinder 122 is retracted at proper time in each cycle of operation to the position shown on the right side of FIG. 14.

Similarly, the vacuum control cam C2 controls twelve vacuum control valves V2 each of which rotates about vacuum control cam C2 and is respectively connected to one of the vacuum suction heads 116 by a vacuum line 117 for applying vacuum to or venting its associated suction head 116 at proper times in each cycle of operation.

Each purge control cam C3 controls twelve high pressure air valves V3 each of which orbits about purge control cam C3 and provides pressurized air through a purge air line 171 to the interior of a workpiece WP in one of the work stations at appropriate times during each cycle of operation.

Figure 34:
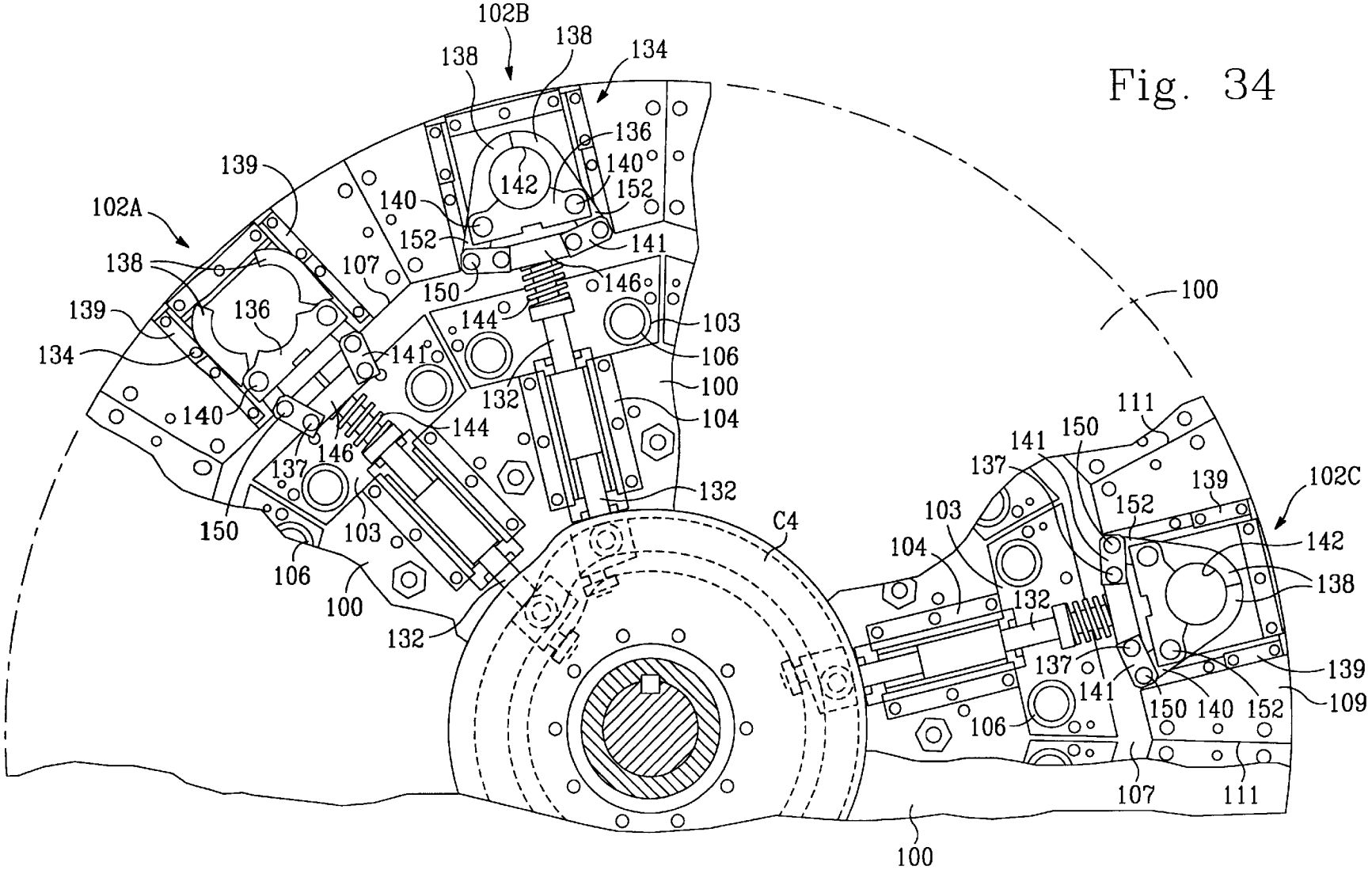
FIG. 34 is a top plan view of several mold members and the cam control means for such mold members.

The main components of each mold are a stationary or fixed mold portion 136 and two pivotal mold portions 138 which are mounted for pivotal movement about fixed pivots 140 relative to the stationary mold portion 136 as shown in FIG. 34. Pivots 140 and stationary mold portion 136 are mounted on a slide plate 127 having an outer planar surface 128 and an inner planar surface 129. Slide plate 127 is supported on mold support plate 109 for limited radial movement between an outer mold closed position shown in FIGS. 23A and 23B in which outer planar surface engages an outer stop 125 and a retracted position mold open position shown in workstation 102A in FIG. 34. In the retracted position, inner planar surface 129 engages an outwardly facing surface of an inner stop 131 (FIG. 23A). Such shifting of the mold to the retracted position permits the finished container FC to clear the fixed mold component when being lifted from the mold 134 by suction head 116.

Figure 35:
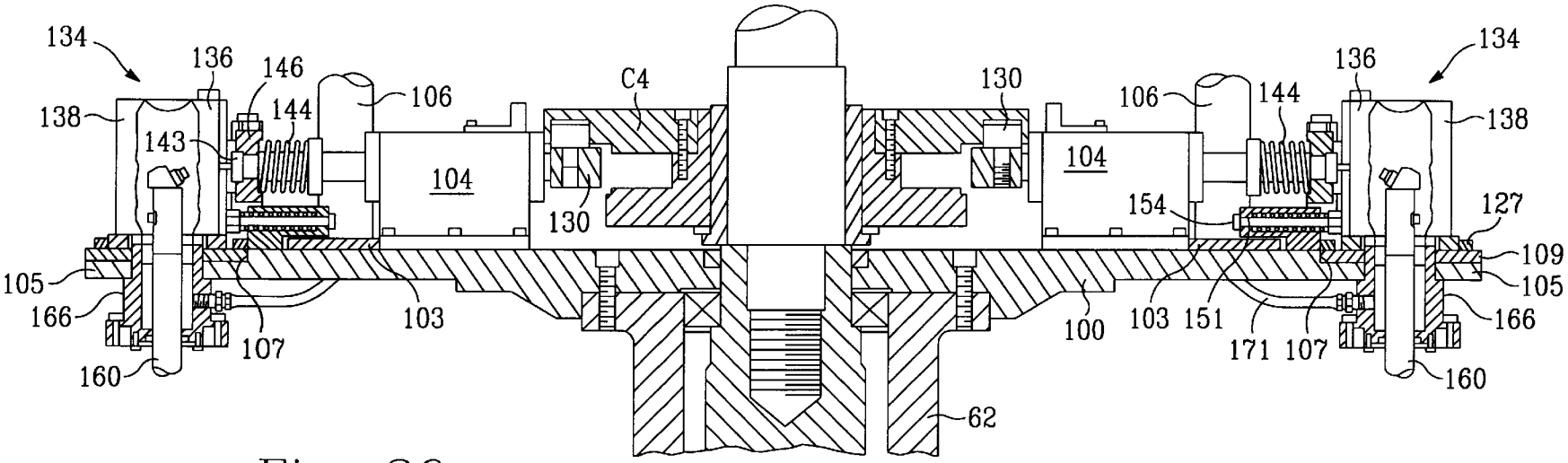
FIG. 35 is a bisecting sectional view taken through FIG. 34.

Mold control cam C4 is engaged by a cam follower 130 mounted on one end of a mold control rod 132 mounted for reciprocation in slide bearing housing 104 as part of each work station 102 as shown in FIG. 34. A transverse drive plate 146 is mounted for limited sliding movement axially wit respect to and on the outer end of control rod 132 and is urged outwardly by spring means 144 toward an end stop 143 fixedly provided on the outer end of rod 132 as shown in FIG. 35. Toggle links 141 are mounted on pivots 137 at each end of the pivot drive plate 146 and are connected to a respective pivotal mold portion 138 by pivot pins 150 mounted on extension arms 152 unitarily extending outwardly from a respective pivotal mold portions 138.

Each mold member 134 is mounted so as to be opened and closed by the reciprocation of its associated mold control rod 132. Mold 134 shown in workstation 102A in FIG. 34 is in the open condition assumed for receiving an unfinished workpiece WP or for permitting removal of finished containers or cans FC whereas the other two mold members 134 in workstations 102B and 102C in FIG. 34 are in their closed condition in which a workpiece is positioned in the mold for reshaping of the wall of the workpiece. When the pivotal mold portions 138 are in their closed condition, they cooperate with the fixed mold portion 136 to define an inner surface 142 having a configuration identical to the desired containers or can configuration.

Figure 37:
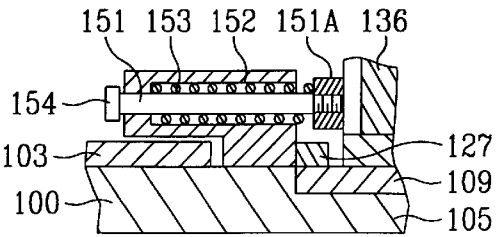
FIG. 37 is a sectional view of the mold travel control means.
Figure 36:
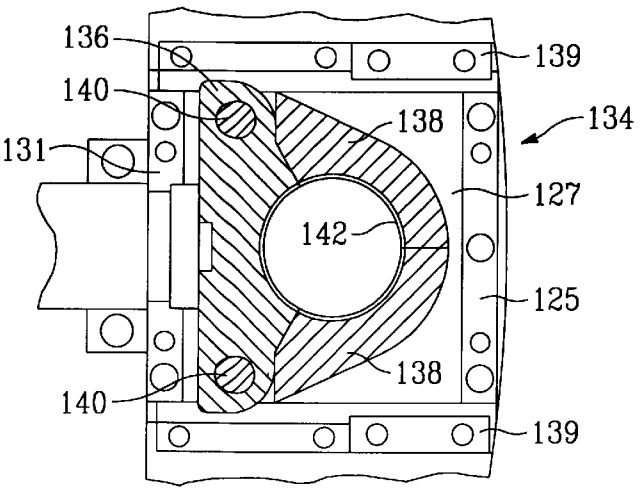
FIG. 36 is a horizontal section view of a mold shown in its closed condition.

Coil compression spring 144 provided on mold control rod 132 operates to urge pivotal mold portions 138 toward the stationary mold constituent 136 so as to tend to position and maintain the mold in a closed condition. However, reciprocation of rod 132 away from the mold by operation of cam C4 serves to open the movable mold portions 138 to assume the open condition shown in workstation 102A in FIG. 34. Side stop members 139 (FIG. 34) limit the extent of opening movement of the pivotal mold portions 138 in an obvious manner. Mold opening and closing movement is controlled by rod 151 mounted in housing 152 which is attached to table 100 as shown in FIGS. 35 and 37. Mold 134 must open before any sliding movement of the mold and must slide into position before any losing movement begins. Rod 151 is threaded into fitting 151A which applies force to mold member 136 as shown in FIG. 37 by means of coil spring 153.The rod head 154 of rod 151 provides a stop for initial assembly only.

Figure 23:
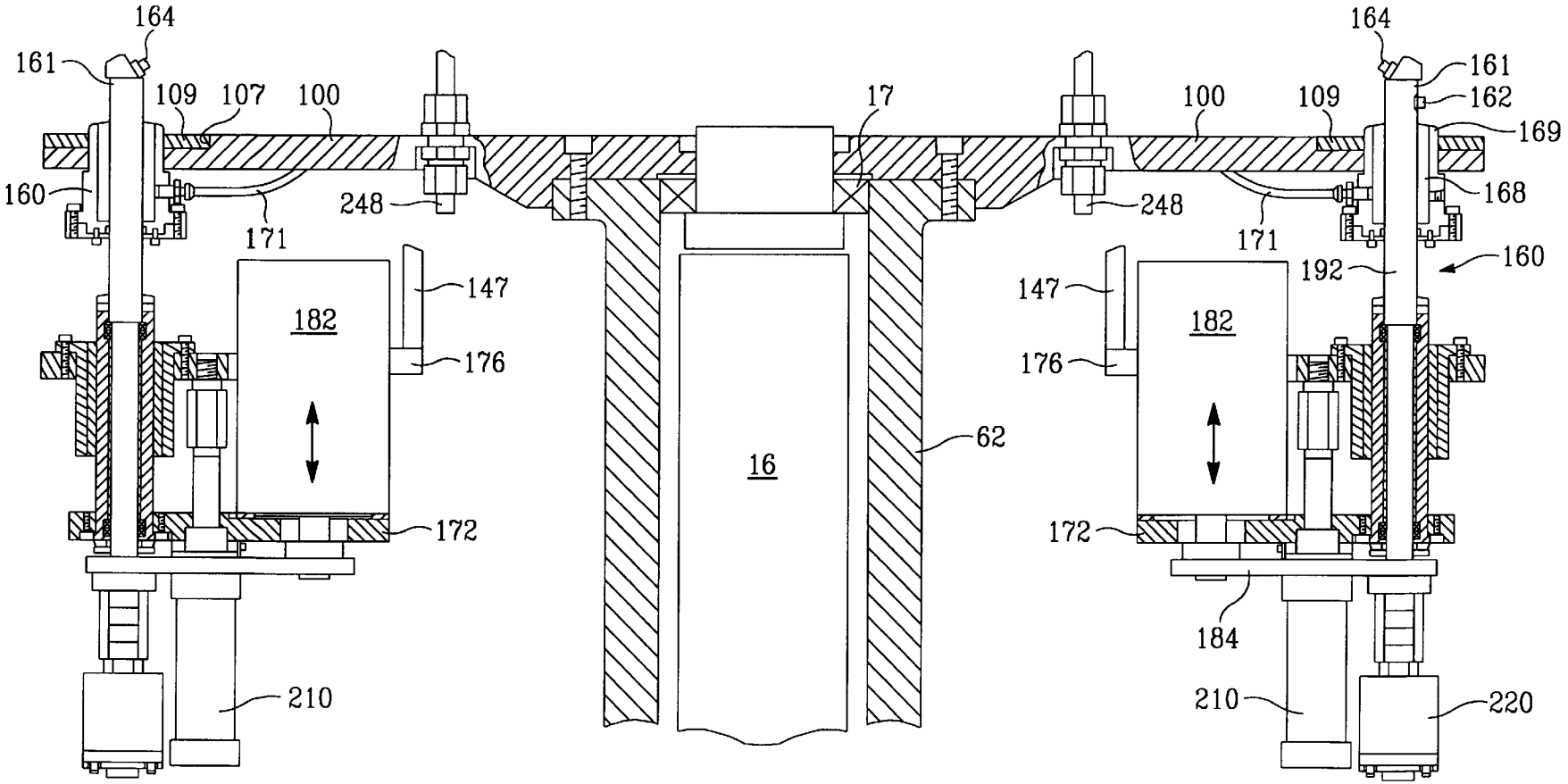
FIG. 23 is a bisecting sectional view of the rotary mold support table and support and control means thereon.

Each work station 102 also includes an axially vertically movable and rotary wand 160 extending upwardly through wand access opening 101 in table 100 as shown in FIG. 23 into the interior of a mold 134 and a inverted workpiece WP positioned within the contoured mold surface 142 of each mold member. The purpose of each wand member is to provide high pressure workfluid jets from a lower radial nozzle 162 and an upper canted nozzle 164 oriented at approximately 30 degrees with respect to the axis of wand 160. Wand 160 rotates about its own axis while being continuously moved vertically within the workpiece so that the jets impinge on the interior wall surface of the workpiece with substantial force thus urging the wall outwardly into conformity with the contour of interior mold surface 142.

Figure 33:
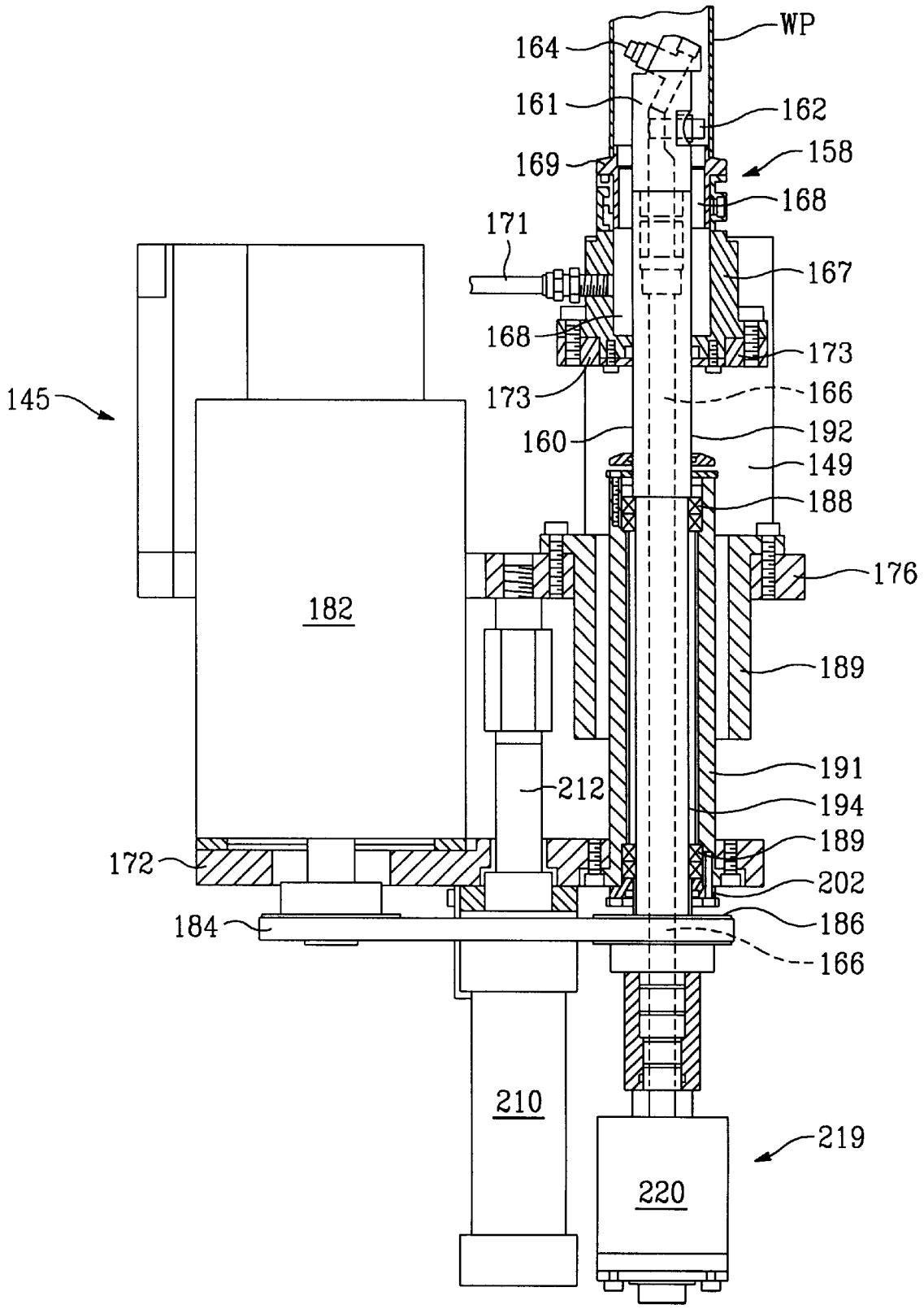
FIG. 33 is a section view along line 33—33 of FIG. 25.

The upper end of wand 160 extends through a closed hollow housing 167 (FIGS. 31 and 33). The closed hollow housing 167 is mounted in a transverse support plate 173 supported on the upper ends of vertical pillar plates 174 which are fixedly connected at their lower ends to fixedly positioned support plate 176 as shown in FIG. 31. Housing 167 has an internal drain chamber 168 opening upwardly to communicate with the interior of a floating annular plastic seal 169 having an upper portion dimensioned to be mateingly received within the downwardly facing open end of a workpiece WP as shown in FIG. 33. A seal bias spring 177 urges seal 169 upwardly against a stop 178 in tubular seal housing 179 which is fixedly attached to housing 167 so as to limit upward movement of the seal. Annular seal means 169 singularly engages the lower inner surface of workpiece WP to permit air from purge air line 171 to enter the workpiece at the beginning of a forming operation to expand the workpiece outwardly. The workfluid drain line 170 communicates with the open- topped drain chamber 168 for permitting discharge of spent workfluid from the interior of the workpiece when the pressure in the workpiece reaches a predetermined value following actuation of the jets in the wand.

Figure 28:
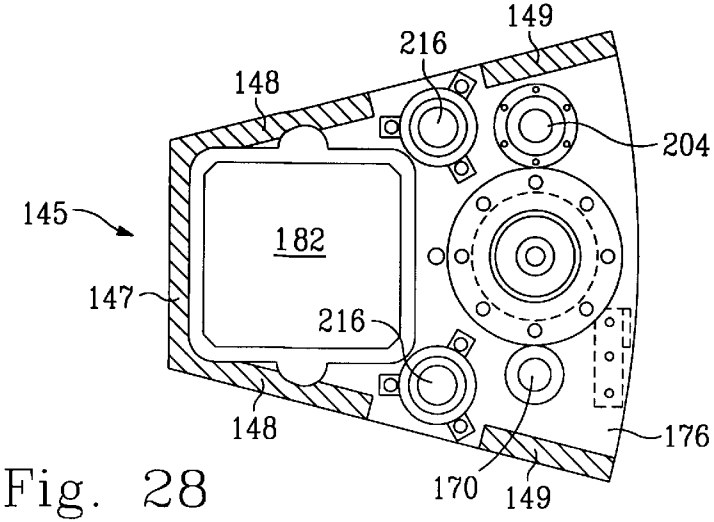
FIG. 28 is a section view taken along line 28—28 of FIG. 26.

Support for the wand 160 and the associated means for rotating the wand about its axis and for reciprocating it axially is provided by a vertically movable aluminum elevator plate 172 positioned beneath and supported by means extending downwardly from rotary mold support table 100. More specifically, such support is provided by a U-shaped wand support bracket 145 (FIGS. 28 and 33) extending downwardly from the lower surface of table 100 and comprising a chordally oriented back plate 147 and two inner side plates 148 (FIG. 23B) which are connected to and support fixedly positioned support plate 176 (FIG. 33). Additionally, outer side plates 149 are attached to, and extend upwardly from, fixed position support plate 172.

Elevator plate 172 is connected to and supported by fixedly positioned support plate 176 by a lead screw drive shaft 204 (FIG. 31) which is threaded in a threaded coupling 206 mounted on fixedly positioned support plate 176. Lead screw 204 is selectively rotated in either direction by a servo motor 208 mounted on elevator plate 172 to raise or lower elevator plate 172 and wand 160. Wand 160 is supported in tubular housing 191 which is connected at its lower end to elevator plate 172 by machine screws as shown in FIG. 33. An upper bearing 188 and lower bearing 189 (FIG. 33) support wand 160 in tubular housing 191 for rotation relative to housing 191. Rotation of wand 160 is effected by a servo drive motor 182 which is mounted on elevator plate 172 and rotates the wand by means of belt 184 and pulley 186 in a manner best shown in FIG. 33.

Figure 29:
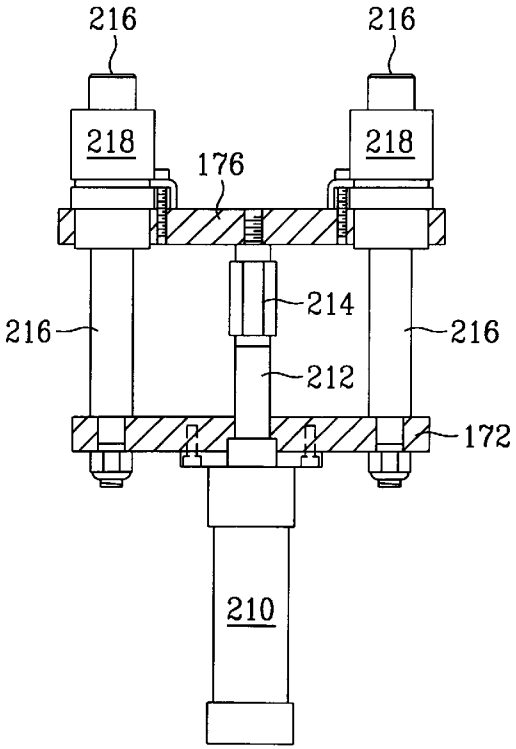
FIG. 29 is a section view taken along line 29—29 of FIG. 27.
Figure 32:
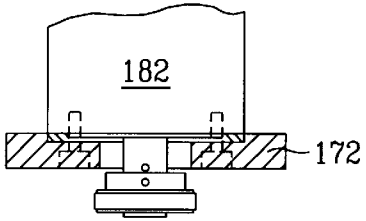
FIG. 32 is a section view along line 32—32 of FIG. 27.
Figure 27:
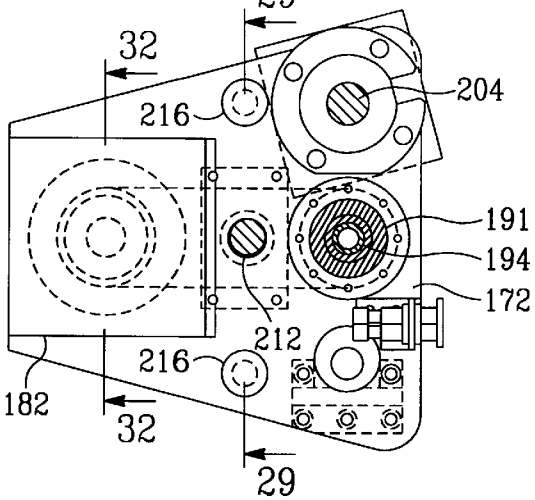
FIG. 27 is a section view taken along line 27—27 of FIG. 26.

An elevator lead screw drive servo motor 208 is drivingly connected to lead screw drive shaft for rotating the lead screw drive shaft to effect vertical movement of elevator plate 172 to cause equivalent vertical movement of wand 160 which is supported by elevator plate 172. The elevator lead screw drive motor 208 is a conventional motor such as a #R43GENA-R2-NS-NV-00 sold by Pacific Scientific; however other similar conventional motors could be employed. Additionally, an air cylinder 210 (FIGS. 23A and 29) is fixedly attached to elevator plate 172 and has a piston rod 212 positioned for vertical movement relative to elevator plate 172. The upper end of piston rod 212 is fixedly connected to the fixedly positioned support plate 176 by an adjustable connector 214. Stabilization rods 216 are fixedly connected by their lower ends to elevator plate 172 and extend upwardly through respective slide bearings 218. Air cylinder 210 is operated to maintain a constant force on elevator plate 172 so that cylinder 210 in effect acts as a spring providing a constant force on elevator plate 172. The weight of elevator plate 172 and attachments are thus transferred to fixed plate 176. The force required by the lead screw drive is thus limited to the inertia generated by the moving components. This allows for maximum servo starting and starting speed ramps.

A proximity switch mounting bracket 93 is attached to elevator plate 172 for movement with the elevator plate adjacent a proximity switch trip bracket 94 having trip tab 95 overlying the face of switch mounting bracket 93. An upper position sensor 97 and a lower position sensor 98 on bracket 93 provide position signals to the control when covered by trip tab 95 respectively indicative of elevator plate 172 being in its upper limit position of travel or its lower limit position of travel.

The upper end of wand 160 communicates with axial bore 166 which extends the length of wand 160 and delivers high pressure water from the high pressure rotary coupling 219 attached to its lower end of the wand to the nozzle members 162 and 164. The upper portion of wand 160 extends through and is vertically movable in hollow housing 167 as best shown in FIG. 33.

The lower end of wand 160 is connected to the high pressure rotary coupling 219 which has a housing 220 the details of which are shown in FIGS. 44 through 51. The housing 220 of the high pressure coupling 219 comprises a non-rotating lower end cap 222 and an upper housing component 226 fixedly connected to the non-rotating cap 222 by machine screws 228.An axial passageway 224 extends the entire length of the high pressure rotary coupling. A rotary discharge component 230 is axially positioned within the upper housing component 226 and has a threaded portion 231 at its upper end which is threaded into the lower end of wand 160 for rotation coaxially with the wand.

A fine grade carbide seal 232 is brazed to the lower end of rotary component 230 and faces a lower carbide seal 234 brazed to the upper end of a pusher component 236. A wave spring 238 urges pusher component 235 upwardly so as to urge upper rotary carbide seal 234 against fixedly positioned lower carbide seal 232. The contacting surfaces of carbide seals 232 and 234 are finely polished to insure minimal leakage. The seal members 232 are formed of a fine grade carbide such as VC 101 sold by the Valenite Corporation with the carbide particles being of sub-micron size. It has been found that this rotary coupling is capable of operating at up to 8,000 rpm, three thousand pounds per square inch pressure and with a capacity of 16 gallons per minute flow through the unit.

Workfluid is provided to the high pressure rotary coupling 219 by a high pressure rotary union 246 having and outer rotary sleeve 247 and being mounted on the support column as shown in FIG. 14. High pressure rotary union 246 receives workfluid from the interior of the fixedly positioned upper column component 27 and delivers it through outer rotary sleeve 247 to high pressure outlet line 248 (FIG. 14) which is connected to an inlet port of valve block 66 as shown in FIG. 1A. Valve block 66 directs the workfluid to the inlet of the electrically controlled high pressure workfluid supply solenoid valve 68. Opening of valve 68 by an electrical signal permits the high pressure workfluid to flow from high pressure workfluid supply solenoid valve 68 into the fixedly positioned lower end cap 222 of high pressure rotary union 219 by means of a high pressure flexible connector hose 250 and lower coupling fittings 251 and upper coupling fitting 252 as best shown in FIG. 31A.

Upper column component 27 has a flared coupling 266 threaded on to its external threaded surface 34 as shown in FIG. 43. A six-sided electrical component housing generally designated 268 having outer side walls 270 and inner side walls 272, a bottom or floor wall 274 and a top wall in 276 as shown in FIGS. 43 and 1B surrounds the flared coupling 266. A cover plug 278 is axially received in the upper end of flared coupling 266 and is retained therein by machine screws 280.

Figure 43A:
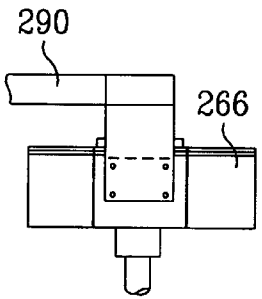
FIG. 43A is a front elevation partially in section of upper brace components of the preferred embodiment.

Structural stability and rigidity for the support column 16 etc., is provided by a bracing system consisting of a cantilever brace 282 connected by machine screws or similar connectors to a main frame component 286 as shown in FIG. 43A. A transverse frame 288 is connected to the inner end of cantilever brace of 282 as best shown in FIG. 43 with parallel frame members 290 extending inwardly from transverse frame member 288. The inner ends of parallel frames 290 are connected through one of the exterior walls 270 of the electrical housing 268 to the brackets 275 so as to stabilize the upper end of the support column. Additionally, electrical conduits 292 extend inwardly from the frame and are connected to the upper column assembly as shown in FIG. 43. Lastly, vacuum lines 294 from a vacuum source are also connected in the upper column components as are a high pressure air source line 296 and a low pressure air source line 298.

The downstream end of high pressure workfluid delivery line 338 is connected to the exterior of the cover plug 278 and is retained in position by a hose retainer 300 illustrated in FIG. 43. The delivery line 338 consequently communicates with the axial bore 29 in the upper support column component 27 so that workfluid from pump 336 is delivered to bore 29 from which it is subsequently dispensed to the wands 160 of each workstation.

Workfluid provided in high pressure workfluid delivery line 338 is typically provided at 3000 pounds per square inch pressure and flows into bore 29 which extends downwardly from the upper end of upper component 27 of the column and communicates with the upper ends of opposed slots 30 which in turn communicate with the interior of the high pressure workfluid rotary union 246 from which the workfluid is dispensed via high pressure workfluid supply lines 248 to the various work fluid supply solenoid valves 68 of each workstation.

Rotary slip ring assembly 256 comprises a fixedly positioned stator 302 in which multiple fixedly positioned slip rings 304 are mounted. A cylindrical external rotor shell 306 is supported by bearings 308 for rotation about the axis of upper column component 27 which is also the axis of stator 302. Wires 305 extend outwardly from contact supports 310 which support an electrical brush contact 309 aligned with and in continuous contact with one of the slip rings 304, as shown in FIG. 43C. Conductors 315 extend downwardly inside the stator and are connected to selected slip rings 304; the opposite ends of conductors 315 are connected to fixedly positioned control and power providing components in fixedly positioned power distribution and control enclosure 344 (FIG. 1B).

Cylindrical external rotor shell 306 is driven to rotate in unison with tables 100, 108 and their associated equipment by means of a drive rod 311 connected on an inner end to a radial stud 312 attached to the cylindrical external rotor shell 306 and connected on its outer end by a drive pin 314 attached to a vertical drive block 316 as best shown in FIG. 43. The lower end of vertical drive block 316 is connected to table 108 which is rotated by its driving connection from table 100.

Figure 43B:
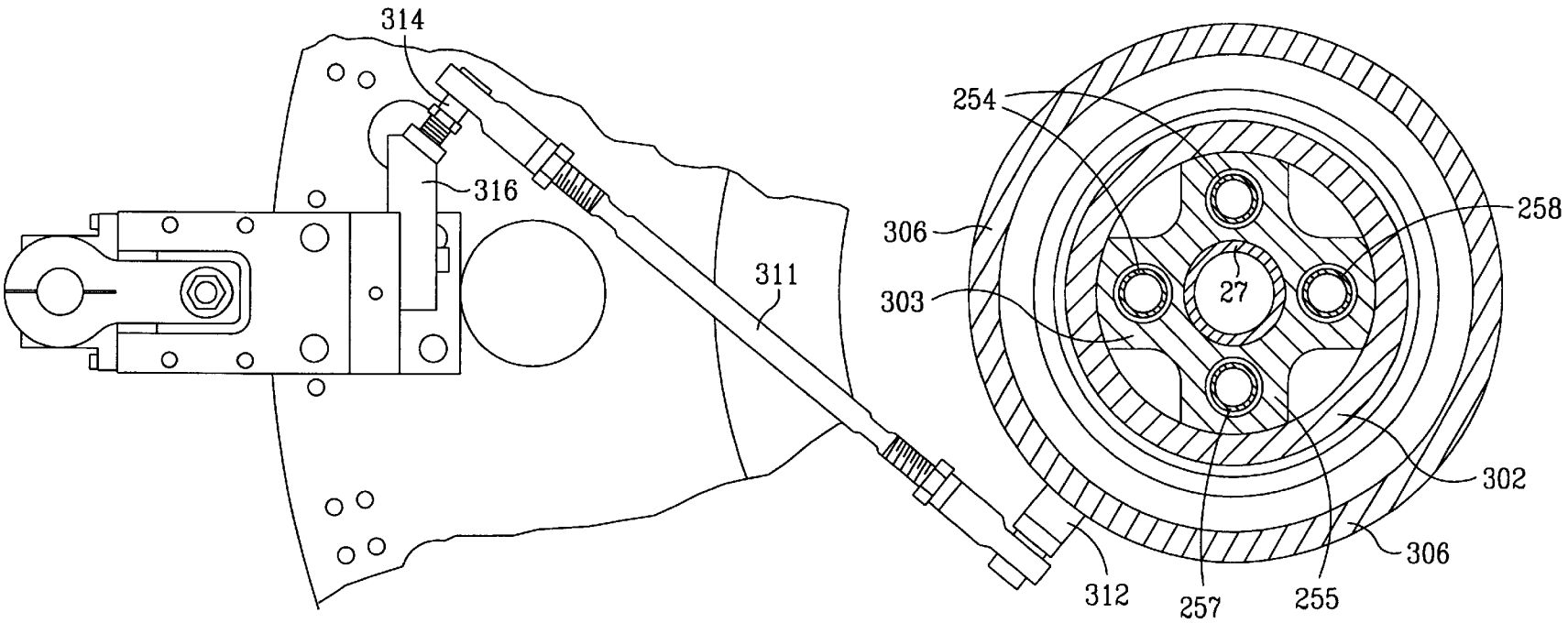
FIG. 43B is a transverse section view taken through the slip ring housing.
Figure 43C:
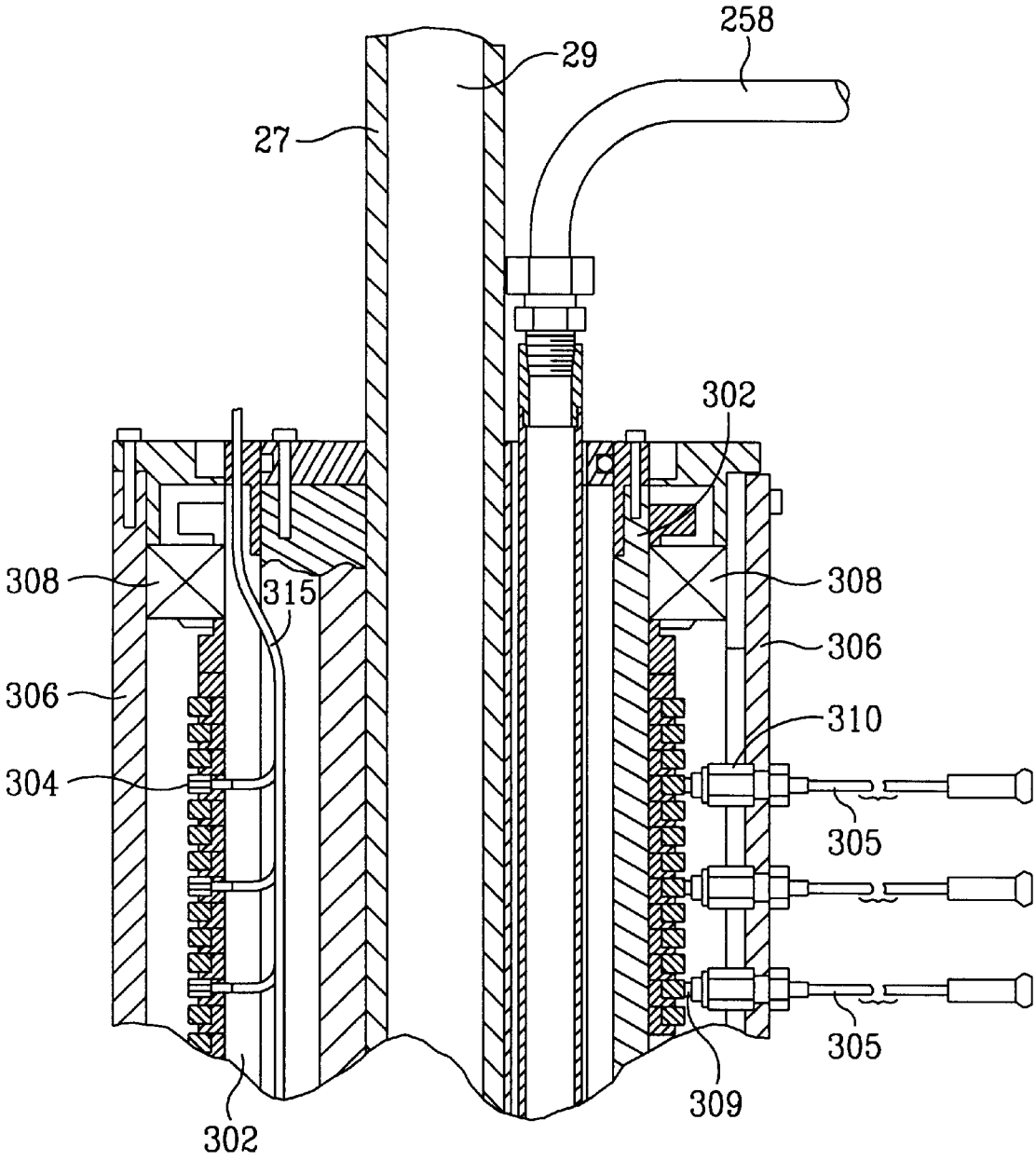
FIG. 43C is a bisecting vertical sectional view of the upper end of the slip ring housing.
Figure 44:
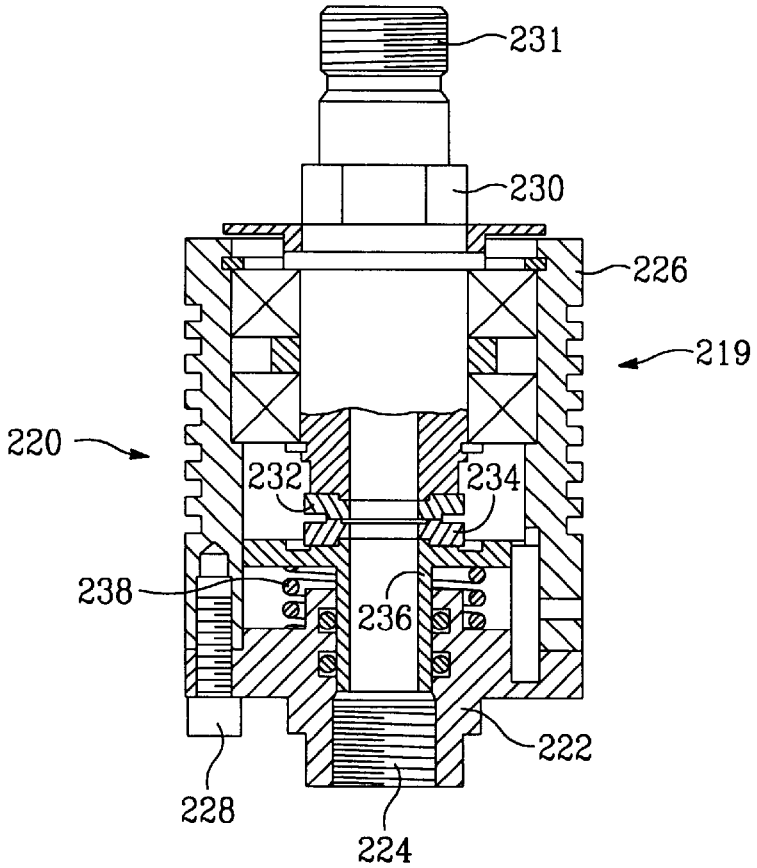
FIG. 44 is a bisecting sectional view of a high pressure workfluid rotary coupling employed for providing workfluid to the rotating wand.
Figure 45:
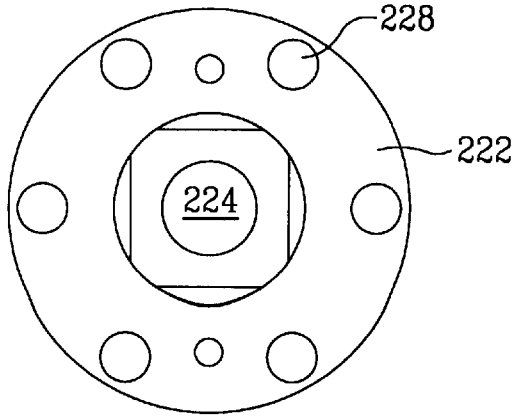
FIG. 45 is a lower plan view of the high pressure workfluid rotary coupling of FIG. 44.
Figure 46:
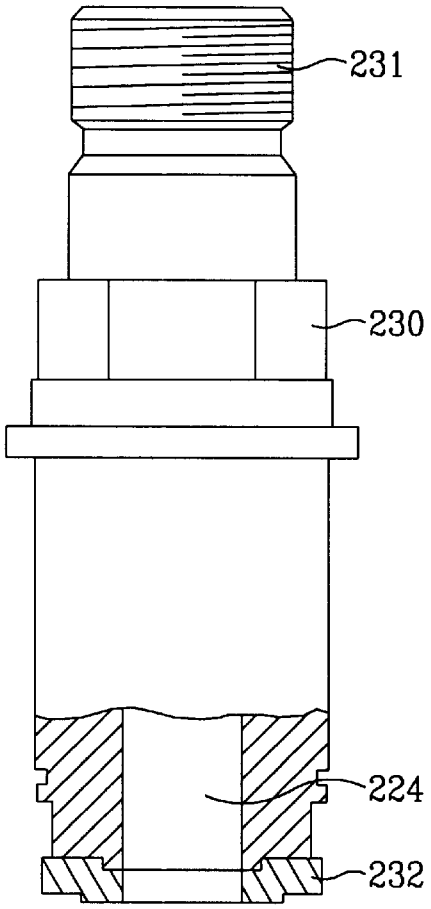
FIG. 46 is a vertical elevation, partially in section, of the upper internal component of the rotary coupling of FIG. 44.
Figure 47:
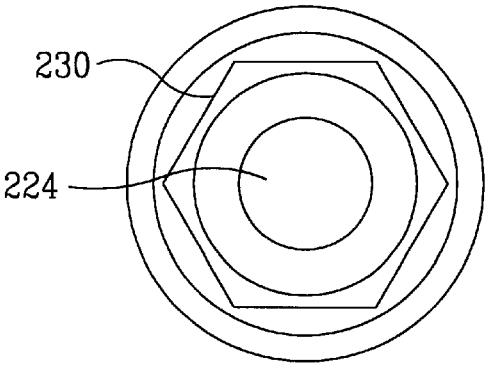
FIG. 47 is a top plan view of the upper internal component of the rotary coupling of FIG. 46.
Figure 48:
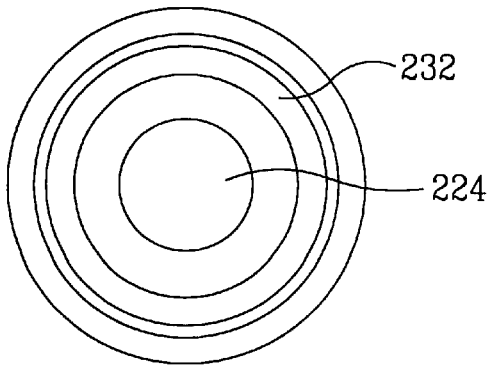
FIG. 48 is a bottom plan view of the upper internal component of the rotary coupling of FIG. 46.
Figure 49:
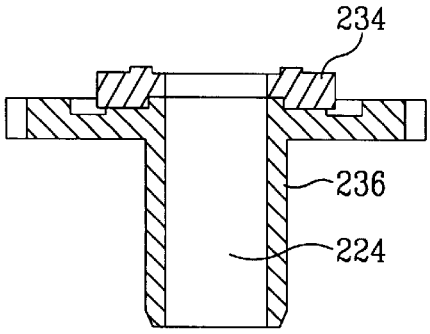
FIG. 49 is a bisecting sectional view of the lower internal component of the rotary coupling of FIG. 44.
Figure 50:
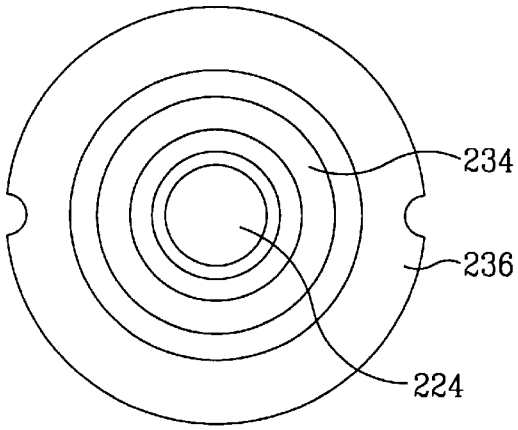
FIG. 50 is a top plan view of the lower internal component of the rotary coupling of FIG. 49.
Figure 51:
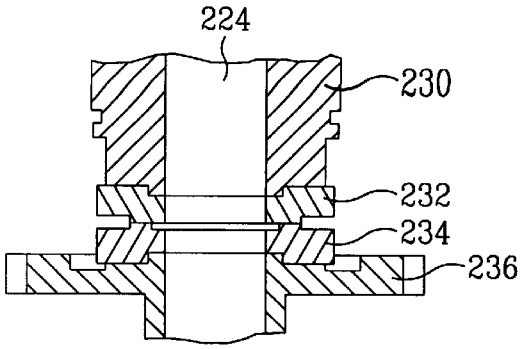
FIG. 51 is a bisecting sectional view of the upper and lower seals in the rotary coupling of FIG. 44.

A cross-shaped spacer 303 is positioned internally of stator 302 as shown in FIG. 43B with upper column component 27 and vacuum lines 254 and low pressure air line 257 and high pressure air line 258 extending downwardly through the spacer as shown. The lower ends of vacuum lines 254 communicate through a gas tight rotary union 253 (FIG. 1B) with vacuum lines V each of which is connected to one of the vacuum control valves V2 so that opening of each valve V2 connects the vacuum source to the respective suction head 116 connected to that vacuum control valve.

Figure 22:
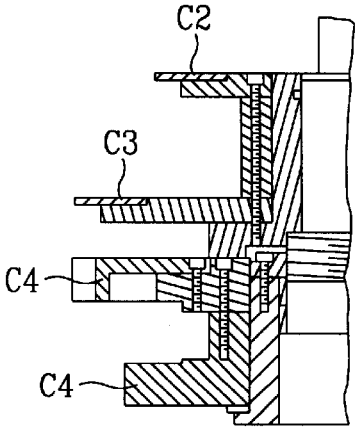
FIG. 22 is an enlarged detailed sectional view of the three control cams of the preferred embodiment.
Figure 19:
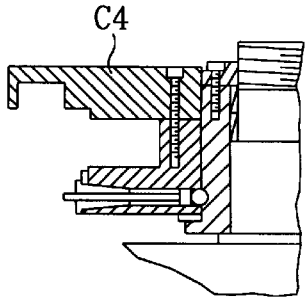
FIG. 19 is an enlarged detailed sectional view of illustrating the overload release mounting of the mold control cam.
Figure 16:
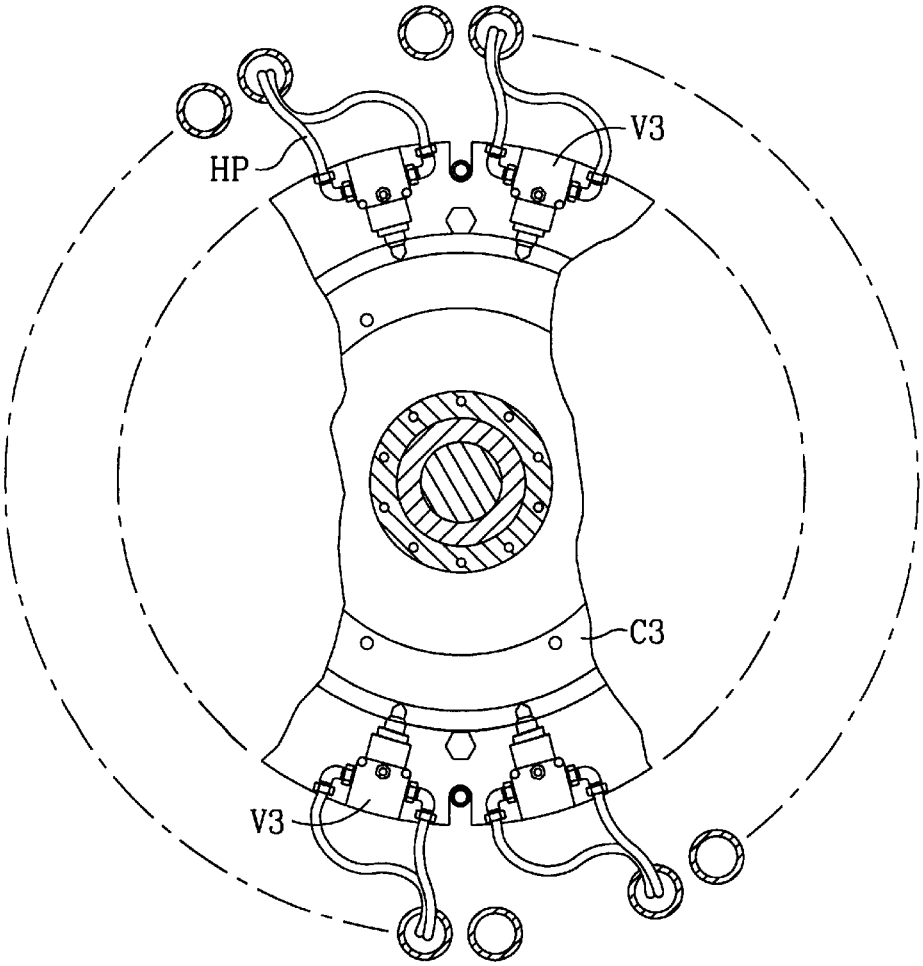
FIG. 16 is a section view taken along line 16—16 of FIG. 14.
Figure 17:
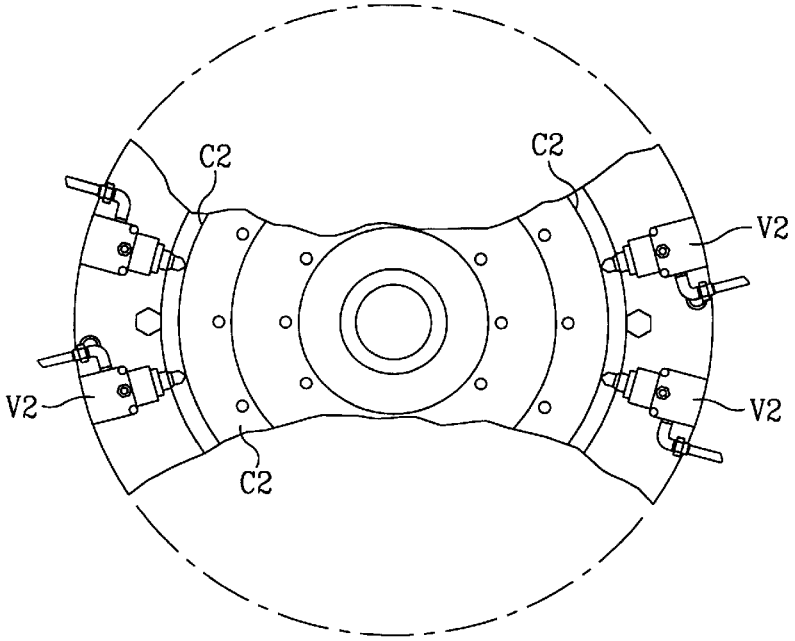
FIG. 17 is a section view taken along line 17—17 of FIG. 14.
Figure 21:
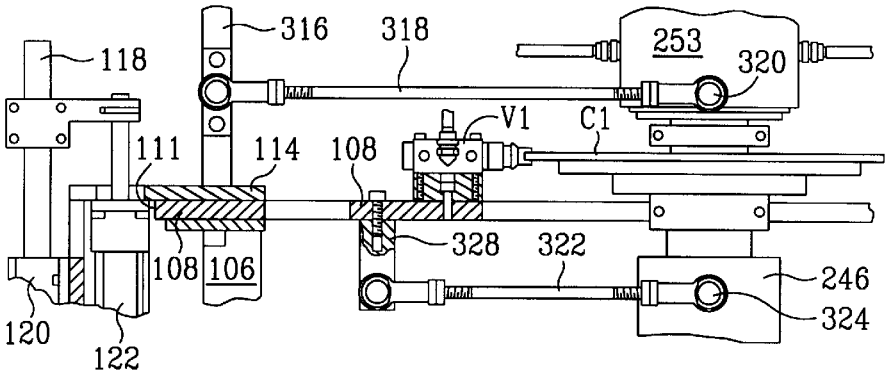
FIG. 21 is a front elevation view of the rotary brush housing drive of FIG. 20.
Figure 20:
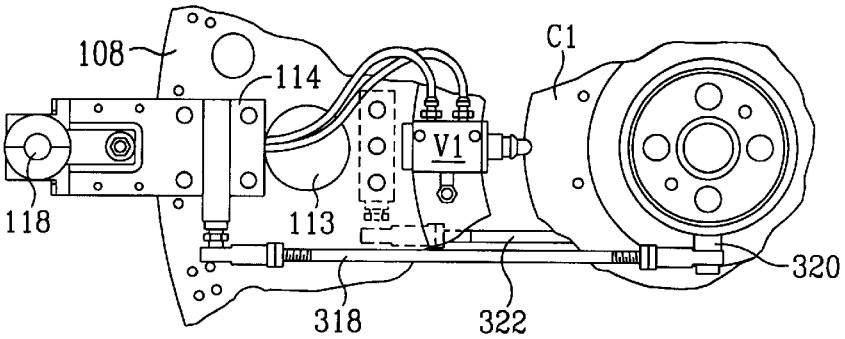
FIG. 20 is an enlarged plan view illustrating drive linkage means for rotating the rotary brush housing about the slip ring assembly.

Air rotary union 253 is rotated in unison with annular rotary support table 108 about support column upper component 27 by a drive rod 318 connected to air rotary union 253 by radial pin means 320 with the outer end of drive rod of 318 being connected to the vertical drive block 316 as best shown in FIG. 21. Similarly, the high pressure workfluid rotary union 246 is rotated about the axis of the support column by a drive rod 322 connected to the rotary union on one end and having its other end connected to a radial pin 324 extending downwardly from the annular rotary table 108 as shown in FIGS. 20 and 22.

The main control means for operation of the inventive apparatus for practice of the inventive method is illustrated in FIG. 54 and includes a fixedly positioned power distribution and control enclosure in which a conventional master programmable logic controller 346 is mounted. Controller 346 is an Allen Bradley Model # PLC 5, part # 1785 L20B; however, other conventional controllers could easily be employed. Input to the master programmable logic controller 346 is provided by a conventional programmable limit switch 348 which is a GEMCO MODEL # 1988 QUIK SET II; however, other conventional equivalent limit switches could also be employed without any difficulty. Signal generating resolver means provides position indicating signals to limit switch 348 in the manner made evident by FIG. 54. Additional control input is provided to master programmable logic controller 346 by a conventional operator's machine control console 345 employing touch screen technology. Motor starters are also provided in fixedly positioned enclosure 344 and are respectively connected to machine drive motor 58, pump motor 90 and high pressure pump motor 337.

The master programmable logic controller is also connected through stator 302, slip rings 304, brush contacts 309 and wires 305 to the movable components enclosed in rotating electrical enclosure 358 as well as valves 68 and 70 and motors 182 and 208 which rotate externally of enclosure. The control elements in rotating enclosure 358 include a conventional slaved programmable logic controller 350 which is an Allen Bradley MODEL # SLC 503 PART # 1785 LCOB device. Other comparable devices could also be used with equal success. Additionally, a servo motor programmable drive 360 is provided in the rotating electrical enclosure 358 for controlling wand drive motor 182. Programmable drive 360 can be a conventional item such as a Pacific Scientific Part # SC934TN-001-01; other equivalent conventional drives could also be used with satisfaction. Another servo motor programmable drive 362 is also provided in the rotating enclosure 358 for controlling elevator lead screw drive servo motor 208. Drive 362 is a Pacific Scientific Part # SC952TN-504-01; however, other conventional servo motor programmable drives could be employed with equal success if desired.

Figure 55:
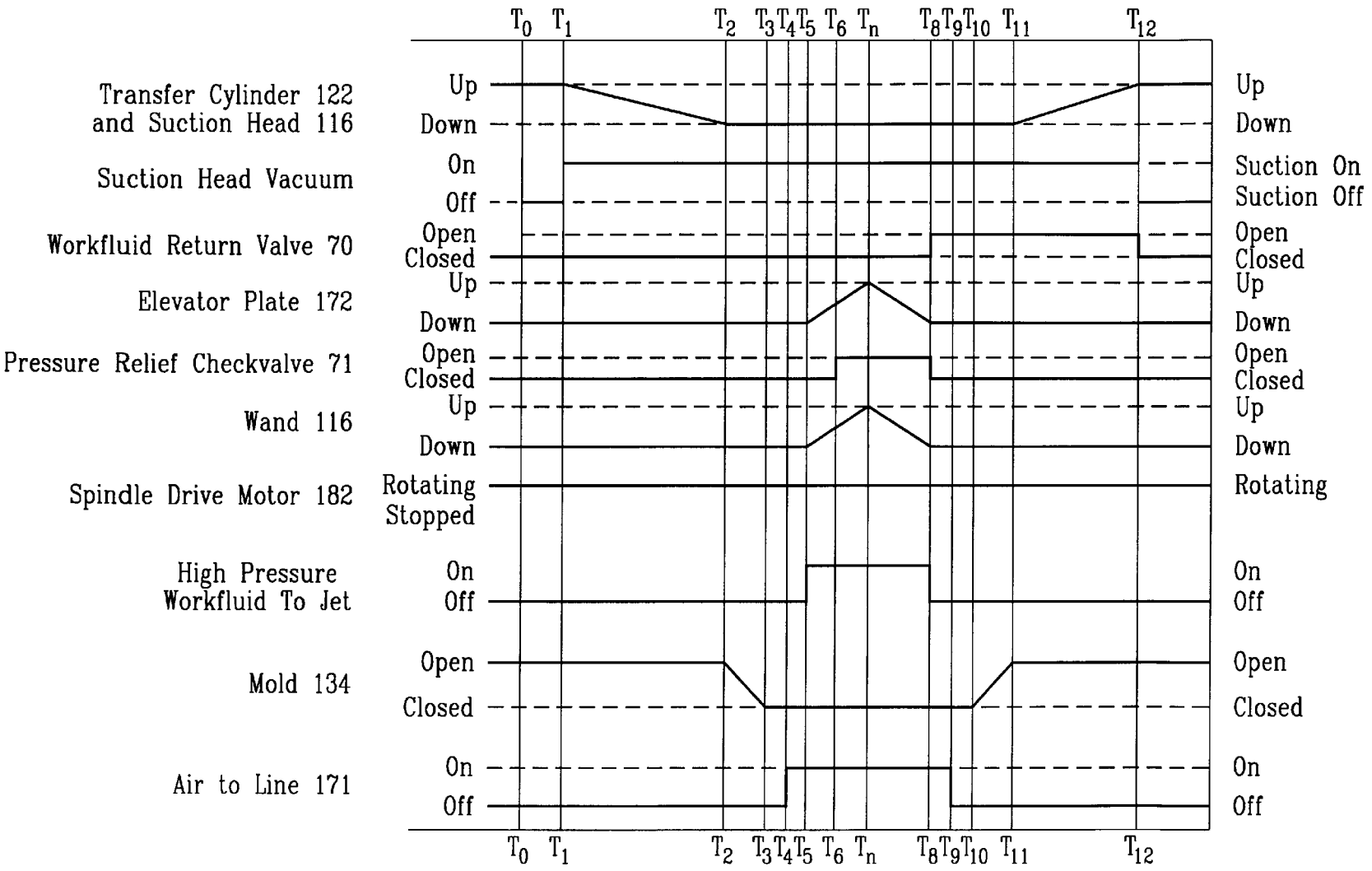
FIG. 55 is a timing chart illustrating a complete cycle of operation of a workstation in the preferred embodiment of the invention.

A complete cycle of operation will now be discussed with respect to a single one of the workstations with it being understood that all of the workstations operate in precisely the same manner. Attention is initially invited to FIG. 55 which illustrates such a complete cycle of operation beginning at time $T_0$.

It should be understood that at time $T_0$ the machine is operating at desired speed by operation of the machine drive motor drive 58 and signal generating resolver 61 is providing continuous position signals to the programmable limit switch 348 and the master programmable logic controller 346 in the power distribution and control enclosure 344. The master programmable logic controller 346 is consequently aware of the position of each workstation and provides appropriate control signals for actuating various components such as the on spindle drive motor 182, the elevator lead screw drive motor 208 and the electrically operable solenoid valves 68 and 70.

At time $T_0$ the transfer cylinder 122 is in its up position so that the suction head 116 is in the elevated position of the suction head on the left side of FIG. 14. Also, the vacuum control valve V2 is in its closed position so that suction or vacuum is not being applied by vacuum line 117 to the suction head 116. Workfluid return solenoid valve 70 is closed. Elevator plate 172 is in its down position and suction head 116 is in its up position. The spindle drive motor 182 is continuously operated and wand 160 is therefore being continuously rotated about its axis at all times during operation of the apparatus. High pressure workfluid supply solenoid valve 68 is in its closed condition so that high pressure workfluid is not being supplied to wand 160 and nozzle members 162 and 164. Mold 134 is in the open position and air valve V3 is in its closed condition so that pressurized air is not being supplied to purge air line 171. A workpiece is being fed into a position in vertical alignment with the suction head 116 by the vacuum infeed starwheel 13A.

At time $T_1$ the workpiece WP moves into alignment with the suction head 116 and vacuum control cam C2 opens vacuum control valve V2 to apply suction to suction head 116 through vacuum line 117 to instantly attract and hold the workpiece by its bottom wall which is facing the suction head since the workpiece is inverted. Also, low pressure air control cam C1 actuates the low pressure air supply valve V1 to cause the valve to supply air to low pressure air line 119 while venting low pressure air line 121 so that cylinder 122 begins to contract and move the suction head 116 downwardly so as to carry the workpiece downwardly into the open mold 134.

At $T_2$ the contraction of cylinder 122 is completed so that the inverted workpiece is fully positioned in the mold and the floating annular plastic seal 169 snugly engages the inside of the workpiece neck as shown in FIG. 33. and the mold control cam C4 begins to move the movable mold component 138 from its open position toward its closed position.

At time $T_3$, the movable pivotal mold portions 138 are in their closed position and the mold has been shifted outwardly radially approximately 0.31 inches into its position in which it is axially aligned with the axis of wand 160. The suction head 116 urges the workpiece downwardly by the application of approximately 20 pounds column pressure to hold the workpiece in the position shown in FIG. 33.

At $T_4$, high pressure air valve V3 is opened to supply purge air to line 171 to pressurize the interior of the workpiece to slightly distend the walls of the WP toward the wall of the mold.

At time $T_5$ the master programmable logic controller 346 which causes high pressure workfluid supply valve 68 to be opened by the slaved programmable logic controller 350 to provide high pressure workfluid to the nozzles 162 and 164. The elevator lead screw drive motor 208 is simultaneously activated to initiate upward movement of elevator plate 172 and wand 160.

At time $T_6$ shortly after activation of the workfluid jets, the pressure on the interior of the can and in drain chamber 168 and drain line 170 rapidly increases because of the effect of the air pressure in the workpiece and the injection of the workfluid in conjunction with the fact that work fluid return solenoid valve 70 and mechanical pressure relief valve 71 are closed. However, when the pressure in workpiece WP, drain chamber 168 and drain line 170 reaches approximately 40 pounds per square inch the pressure relief valve 71 opens to effect a controlled release of workfluid through drain 72. Thus, the spent workfluid draining from the interior of the workpiece is forced outwardly from the workpiece by the air pressure in the workpiece WP so that the static pressure does not appreciably exceed or fall below the 40 psi triggering pressure for valve 71.

At time $T_7$. elevator plate 172 reaches its uppermost position which is detected by proximity switch upper position sensor 97. The elevator lead screw drive servo motor 208 is then driven in a reverse direction so that elevator 172 and wand 116 start moving downwardly so that the high pressure workfluid jets again impinge upon the work area of the interior wall of the workpiece as they rotate about the axis of the wand while the wand is being axially moved to its down position. The wand is being rotated at a high speed such as up to 8000 revolutions per minute so that the wall work surface of the workpiece WP receives a total and complete impact coverage from the discharge from the nozzles.

At time $T_8$ the elevator plate and wand 116 reach their lower position which is detected by lower position sensor 98. The reshaping of the workpiece wall is completed and the high pressure workfluid supply valve is closed to terminate the supply of workfluid to wand 116. Also, workfluid return valve 70 is opened so that the pressurized air in the workpiece, which is now a finished container FC, quickly forces all spent workfluid from the finished container FC and drain chamber mold 168.

At $T_9$ valve V3 is closed and pressurized air in purge air line 171 is also terminated.

At time $T_{10}$, the pivotal mold components begin to open.

At $T_{11}$, the mold reaches its open position and transfer cylinder 122 begins to expand, so as to move suction head 116 upwardly along with the completed container.

At time $T_{12}$, the completed container is brought into one of the container receiving peripheral pockets 373 on the outfeed vacuum starwheel 13B and the suction to suction head 116 is terminated by closure of valve V2 so that the finished container FC is released to outfeed vacuum starwheel which delivers the finished container to outfeed conveyer component 378 defining a removal feedpath.

The inventive apparatus is capable of varying a number of parameters in accordance with the nature of the can wall reshaping that is being done. For example, the rotational speed of the wand, the pressure of the workfluid supplied to the nozzle, the vertical lifting upward and downward movement of the wand and the number of reciprocations of the wand are all capable of variation as required by the particular work being done. It should also be understood that the directional terms such as upward, downward, vertical and the like are employed for establishing relative, not absolute, positions and relationships and should not necessarily be be interpreted literally.

While numerous variations of the subject invention will undoubtably occur to those of skill in the art, it should be understood that the spirit and scope of the invention is to be limited solely by the appended claims.

We claim:

1. An apparatus for shaping the wall of an open-ended workpiece having an open end communicating with an internal cavity in said workpiece, said apparatus comprising:

a mold having an inwardly facing surface having said desired contour; said mold including a moveable mold component and a fixed mold component, said movable mold component being movable between an open position spaced from said fixed mold component to open the mold sufficiently to permit insertion of a workpiece container in the mold and an operating position contacting said fixed mold component to permit operation of the apparatus to effect reforming of the wall of the workpiece container;

support means for supporting said workpiece container within the confines of said inwardly facing surface;

an elongated tubular wand having an axis and an internal passageway for receiving high velocity workfluid;

nozzle means mounted in said wand having an inner end communicating with said internal passageway and an outer discharge end for discharging a high velocity jet of workfluid outwardly for impingement against said inner surface of said wall of said workpiece container;

workfluid supply means for supplying workfluid to said internal passageway at sufficient pressure to result in sufficient jet velocity to cause outward deflection of said wall and permanent distortion of said workpiece container wall into conformity with said inner mold surface as a consequence of the impingement of said high velocity jet on the inner surface of said wall; and a workfluid removal means communicating with the interior of said workpiece container for removing spent workfluid from the workpiece container in during operation of said nozzle means.

2. An apparatus for shaping the wall of an open-ended workpiece having an open end communicating with an internal cavity in said workpiece, said apparatus comprising:

a mold having an inwardly facing surface having said desired contour;

support means for supporting said workpiece container within the confines of said inwardly facing surface;

an elongated tubular wand having an axis and an internal passageway for receiving high velocity workfluid;

nozzle means mounted in said wand having an inner end communicating with said internal passageway and an outer discharge end for discharging a high velocity jet of workfluid outwardly for impingement against said inner surface of said wall of said workpiece container;

workfluid supply means for supplying workfluid to said internal passageway at sufficient pressure to result in sufficient jet velocity to cause outward deflection of said wall and permanent distortion of said workpiece container wall into conformity with said inner mold surface as a consequence of the impingement of said high velocity jet on the inner surface of said wall;

a workfluid removal means communicating with the interior of said workpiece container for removing spent workfluid from the workpiece container in during operation of said nozzle means; and a rotary support mounted for rotation about a vertical axis and providing support for said mold, said elongated wand and said workfluid removing means for rotation about said vertical axis.

3. The apparatus of claim 2 additionally including wand rotating drive means supported by said rotary support for rotating said elongated wand about its axis.

4. The apparatus of claim 3 additionally including wand shifting drive means mounted on said rotary support for moving said wand axially relative to said mold means.

5. An apparatus as recited in claim 4 including workpiece infeed means comprising a pneumatic means for feeding workpieces along an infeed path; a vacuum starwheel mounted for rotation adjacent said infeed path and extending into said infeed path; workpiece receiving indentations provided in the periphery of said vacuum starwheel for receiving a workpiece moving along said infeed path in each indentation for removing the workpiece from said infeed path by rotation of the centerline axis of the workpiece along a circular path a portion of which is aligned with said infeed path so that a workpiece in said infeed path moves into one of said workpiece receiving indentations following which continued rotation of said vacuum starwheel removes said workpiece from said infeed path for subsequent movement into vertical alignment with said mold to permit deposit of the workpiece into the mold.

6. The apparatus of claim 5 wherein said infeed path is linear.

7. An apparatus as recited in claim 5 additionally including workpiece outfeed means comprising pneumatic outfeed conveyor means for feeding workpieces along a removal feedpath; an outfeed vacuum starwheel mounted for rotation adjacent said removal feedpath; an outfeed vacuum starwheel mounted for rotation adjacent said removal feedpath and extending into said removal feedpath; workpiece receiving indentations provided in the periphery of said outfeed vacuum starwheel for receiving a workpiece from said mold indentation for removing the workpiece from said mold by rotation of the centerline axis of the workpiece along a circular path a portion of which is aligned with said removal feedpath so that a workpiece in said mold moves into one of said workpiece receiving indentations in said outfeed vacuum starwheel following which contained rotation of said vacuum starwheel removes said workpiece from said mold for subsequent movement into said pneumatic outfeed conveyor means.

8. An apparatus as recited in claim 7 wherein said infeed path and said outfeed path are linear.

9. An apparatus for shaping the wall of an open-ended workpiece having an open end communicating with an internal cavity in said workpiece, said apparatus comprising:

a mold having an inwardly facing surface having said desired contour; wherein said workfluid supply means includes a rotary coupling comprising a non-rotating lower end cap having an upper end and a lower end connected to a flexible conduit in which high pressure workfluid is supplied and having an axial passageway extending between said upper and lower ends, a rotary upper discharge component having an axial outflow passageway that is coaxial with said axial inflow passageway and a lower end facing the upper end of said non-rotating lower end cap, a pusher member mounted for non-rotary axial movement internally of said non-rotating lower end cap and having upper and lower ends, a fixedly positioned annular lower carbide seal fixedly connected to the upper end of said pusher member and having an axial passageway aligned with the axial passageway in said non-rotating lower end cap, an annular upper carbide seal coaxially positioned relative to and fixedly connected to the lower end of said rotary upper discharge component and having an axial passageway aligned with the axial passageway in said lower carbide seal, said upper and lower carbide seals having facing radial end sealing surfaces and biasing means urging said pusher member toward said upper carbide seal to forcefully engage each other to permit high pressure flow of liquid through the upper and lower seal means with minimal leakage;

support means for supporting said workpiece container within the confines of said inwardly facing surface;

an elongated tubular wand having an axis and an internal passageway for receiving high velocity workfluid;

nozzle means mounted in said wand having an inner end communicating with said internal passageway and an outer discharge end for discharging a high velocity jet of workfluid outwardly for impingement against said inner surface of said wall of said workpiece container;

workfluid supply means for supplying workfluid to said internal passageway at sufficient pressure to result in sufficient jet velocity to cause outward deflection of said wall and permanent distortion of said workpiece container wall into conformity with said inner mold surface as a consequence of the impingement of said high velocity jet on the inner surface of said wall; and a workfluid removal means communicating with the interior of said workpiece container for removing spent workfluid from the workpiece container in during operation of said nozzle means.

10. An apparatus for shaping the wall of an open-ended workpiece having an open end communicating with an internal cavity defined by an inner surface of a wall of said workpiece, said apparatus comprising:

a mold having an inwardly facing surface having said desired contour which is defined by inner surfaces of two pivotable mold components and an inner surface of a fixed mold component, said pivotable mold components being pivotable relative to said fixed mold component between an open position spaced from said fixed mold component sufficiently to permit insertion of a workpiece in the mold and an operating position contacting each other and said fixed mold component to define the inwardly facing surface having the desired contour to permit operation of the apparatus to effect reforming of the wall of the workpiece into a container having said desired contour;

workpiece support means supporting said workpiece within the confines of said inwardly facing surface;

an elongated tubular wand having an axis and an internal passageway for receiving high pressure workfluid;

nozzle means mounted in said wand having an inner end communicating with said internal passageway and an outer discharge end for discharging a high velocity jet of workfluid outwardly for impingement against the inner surface of said wall of said workpiece;

workfluid supply means supplying workfluid to said internal passageway of said elongated tubular wand at sufficient pressure to result in sufficient jet velocity to cause outward deflection of said wall and permanent distortion of said workpiece wall into conformity with said inner mold surface as a consequence of the impingement of said high velocity jet on the inner surface of said wall; and a pressure controlled workfluid removal means communicating with the interior of said workpiece and operable in response to pressure in the interior of the workpiece reaching a predetermined value for removing spent workfluid from the workpiece during operation of said nozzle means.

11. An apparatus for shaping the wall of an open-ended workpiece having an open end communicating with an internal cavity in said workpiece, said apparatus comprising:

a mold having an inwardly facing surface having said desired contour;

support means for supporting said workpiece container within the confines of said inwardly facing surface;

an elongated tubular wand having an axis and an internal passageway for receiving high velocity workfluid;

nozzle means mounted in said wand having an inner end communicating with said internal passageway and an outer discharge end for discharging a high velocity jet of workfluid outwardly for impingement against said inner surface of said wall of said workpiece container;

workfluid supply means for supplying workfluid to said internal passageway at sufficient pressure to result in sufficient jet velocity to cause outward deflection of said wall and permanent distortion of said workpiece container wall into conformity with said inner mold surface as a consequence of the impingement of said high velocity jet on the inner surface of said wall;

a workfluid removal means communicating with the interior of said workpiece container for removing spent workfluid from the workpiece container during operation of said nozzle means; and a rotary support mounted for rotation about a vertical axis and providing support for said mold, said elongated wand and said workfluid removing means at a location radially outward of said vertical axis for bodily rotation about said vertical axis.

12. The apparatus of claim 11 additionally including wand rotating drive means supported by said rotary support for rotating said elongated wand about its axis.

13. The apparatus of claim 12 additionally including wand shifting drive means mounted on said rotary support for moving said wand axially relative to said mold means.

14. An apparatus as recited in claim 13 including workpiece infeed means comprising a pneumatic means for feeding workpieces along an infeed path; a vacuum starwheel mounted for rotation adjacent said infeed path and extending into said infeed path; workpiece receiving indentations provided in the periphery of said vacuum starwheel for receiving a workpiece moving along said infeed path in each indentation for removing the workpiece from said infeed path by rotation of the centerline axis of the workpiece along a circular path a portion of which is aligned with said infeed path so that a workpiece in said infeed path moves into one of said workpiece receiving indentations following which continued rotation of said vacuum starwheel removes said workpiece from said infeed path for subsequent movement into vertical alignment with said mold to permit deposit of the workpiece into the mold.

15. The apparatus of claim 14 wherein said infeed path is linear.

16. An apparatus as recited in claim 14 additionally including workpiece outfeed means comprising pneumatic outfeed conveyor means for feeding workpieces along a removal feedpath; an outfeed vacuum starwheel mounted for rotation adjacent said removal feedpath; an outfeed vacuum starwheel mounted for rotation adjacent said removal feedpath and extending into said removal feedpath; workpiece receiving indentations provided in the periphery of said outfeed vacuum starwheel for receiving a workpiece from said mold indentation for removing the workpiece from said mold by rotation of the centerline axis of the workpiece along a circular path a portion of which is aligned with said removal feedpath so that a workpiece in said mold moves into one of said workpiece receiving indentations in said outfeed vacuum starwheel following which contained rotation of said vacuum starwheel removes said workpiece from said mold for subsequent movement into said pneumatic outfeed conveyor means.

17. An apparatus as recited in claim 16 wherein said infeed path and said outfeed path are linear.

* * * * *